US008560401B1

(12) United States Patent
Bharara et al.

(10) Patent No.: US 8,560,401 B1
(45) Date of Patent: Oct. 15, 2013

(54) ELECTRONIC GIFT REGISTRY MANAGEMENT

(75) Inventors: Vinit Bharara, New York, NY (US); Tara Lawrence Wohlgemuth, North Caldwell, NJ (US); Marc Eric Lore, Mountain Lakes, NJ (US)

(73) Assignee: Quidsi, Inc., Jersey City, NJ (US)

( * ) Notice: Subject to any disclaimer, the term of this patent is extended or adjusted under 35 U.S.C. 154(b) by 394 days.

(21) Appl. No.: 13/019,800

(22) Filed: Feb. 2, 2011

Related U.S. Application Data

(60) Provisional application No. 61/300,539, filed on Feb. 2, 2010.

(51) Int. Cl.
*G06Q 30/00* (2012.01)

(52) U.S. Cl.
USPC ..... 705/26.8; 705/26.1; 705/26.81; 705/27.1

(58) Field of Classification Search
USPC ..... 705/26.1, 27.1, 26.8, 26.81
See application file for complete search history.

(56) References Cited

U.S. PATENT DOCUMENTS

| | | | |
|---|---|---|---|
| 5,072,397 | A | 12/1991 | Barns-Slavin et al. |
| 5,815,398 | A | 9/1998 | Dighe et al. |
| 5,936,863 | A | 8/1999 | Kostelnik et al. |
| 6,064,981 | A | 5/2000 | Barni et al. |
| 6,119,099 | A | 9/2000 | Walker et al. |
| 6,233,568 | B1 | 5/2001 | Kara |
| 6,321,211 | B1 | 11/2001 | Dodd |
| 6,615,104 | B2 | 9/2003 | England et al. |
| 6,721,762 | B1 | 4/2004 | Levine et al. |
| 6,876,958 | B1 | 4/2005 | Chowdhury et al. |
| 6,882,892 | B2 | 4/2005 | Farrah et al. |
| 6,980,934 | B1 | 12/2005 | Sadovnik |
| 7,035,832 | B1 | 4/2006 | Kara |
| 7,085,687 | B2 | 8/2006 | Eckenwiler et al. |
| 2001/0039516 | A1 | 11/2001 | Bennett et al. |
| 2002/0046191 | A1 | 4/2002 | Joao |
| 2003/0200111 | A1 | 10/2003 | Damji |
| 2004/0111336 | A1 | 6/2004 | Argust et al. |
| 2004/0249723 | A1 | 12/2004 | Mayer |
| 2004/0254808 | A1 | 12/2004 | Bennett et al. |
| 2005/0010424 | A1 | 1/2005 | Sherman et al. |

(Continued)

OTHER PUBLICATIONS

Ferriolo, Shayne; "When Less Isn't More", Jan. 2003, Catalog Age, p. 38-39.

(Continued)

*Primary Examiner* — Courtney Stopp
(74) *Attorney, Agent, or Firm* — Seed IP Law Group PLLC

(57) ABSTRACT

Implementations of methods of the present disclosure include managing an electronic gift registry by establishing an electronic gift registry for a registrant, accessing information about multiple different products that are available to be added to the registrant's gift registry, enabling display of a graphical user interface that presents indications of at least some of the different products that are available to be added to the registrant's gift registry, enabling the registrant to add to the registrant's electronic gift registry the different products for which indications are presented within the graphical user interface by interacting with the graphical user interface, and enabling the registrant to designate one or more products that the registrant has added to the registrant's electronic gift registry as products that, once purchased by a gift giver, are not to be shipped until after receiving a future authorization from the registrant to ship the products.

20 Claims, 24 Drawing Sheets

(56) References Cited

U.S. PATENT DOCUMENTS

| | | | | |
|---|---|---|---|---|
| 2006/0095354 | A1 | 5/2006 | Hamzy et al. | |
| 2006/0195364 | A1 | 8/2006 | Shroff et al. | |
| 2006/0271387 | A1 | 11/2006 | Gruger et al. | |
| 2008/0154659 | A1 | 6/2008 | Bettes et al. | |
| 2008/0294477 | A1 | 11/2008 | Lore et al. | |
| 2009/0099935 | A1 | 4/2009 | Hamzy et al. | |
| 2009/0138365 | A1 | 5/2009 | Mueller et al. | |
| 2009/0254447 | A1 * | 10/2009 | Blades | 705/26 |

OTHER PUBLICATIONS

Miller, Paul and Del Franco, "The Price of free S&H", Oct. 2002, pg. 0__1 (4 pgs).

"Learn more-Reserve Membership Program" [online]. Williams-Sonoma, Inc. 2011, [retrieved on Feb. 2, 2011]. Retrieved from the Internet: <URL: http://www.williams-sonoma.com/customer-senvice/membership/faq.html#q 00 >.

USPTO non-final Office Action in U.S. Appl. No. 12/126,435, mailed Oct. 8, 2010, 25 pages.

* cited by examiner

ELECTRONIC GIFT REGISTRY MANAGEMENT

CROSS-REFERENCE TO RELATED APPLICATIONS

This application claims the benefit of priority to U.S. Provisional Application No. 61/300,539, filed on Feb. 2, 2010, which is incorporated by reference in its entirety.

TECHNICAL FIELD

This disclosure relates to managing an electronic gift registry.

BACKGROUND

Generally, some online retailers provide web sites that allow consumers to purchase products or services over the Internet. For example, a consumer using a web browser running on a computing device can access web pages for an online retailer. Referred to as online shopping, the consumer can browse the web pages provided by the online retailer and select items for purchase.

SUMMARY

In a first aspect, implementations of the present disclosure provide computer implemented methods for managing an electronic gift registry including establishing an electronic gift registry for a registrant, accessing, from a computer memory storage system, information about multiple different products that are available to be added to the registrant's gift registry, enabling display, at a computing system and to the registrant, of a graphical user interface that presents indications of at least some of the different products that are available to be added to the registrant's gift registry, enabling the registrant to add to the registrant's electronic gift registry the different products for which indications are presented within the graphical user interface by interacting with the graphical user interface, and enabling the registrant to designate one or more products that the registrant has added to the registrant's electronic gift registry as products that, once purchased by a gift giver, are not to be shipped until after receiving a future authorization from the registrant to ship the products, by interacting with the graphical user interface.

Implementations may include one or more of the following features. In some implementations, the method further includes enabling the registrant to designate one or more products that the registrant has added to the registrant's electronic gift registry as products that, once purchased by a gift giver, is shippable at any time, by interacting with the graphical user interface. In some implementations, interacting with the graphical user interface by the registrant to designate one or more products as products that are not to be shipped until after receiving the future authorization from the registrant to ship the products includes activating, by the registrant, a corresponding shipping hold option for each of the one or more products. In some implementations, the shipment designation for each of the one or more products included in the registrant's electronic gift registry is stored in the computer memory storage system that stores gift registry information for the registrant.

In a second aspect, implementations of the present disclosure provide computer-implemented methods for managing an electronic gift registry including establishing an electronic gift registry for a registrant, receiving an indication of a critical date specified by the registrant, the critical date specified by the registrant being a date in the future, accessing, from a computer memory storage system, information about multiple different products that are available to be added to the registrant's gift registry, enabling display, at a computing system and to the registrant, of a graphical user interface that presents indications of at least some of the different products that are available to be added to the registrant's gift registry, enabling the registrant to add to the registrant's electronic gift registry the different products for which indications are presented within the graphical user interface by interacting with the graphical user interface, and enabling the registrant to designate one or more products that the registrant has added to the registrant's electronic gift registry as products that, once purchased by a gift giver, are not to be shipped until after the critical date specified by the registrant by interacting with the graphical user interface.

Implementations may include one or more of the following features. In some implementations, the method further includes enabling the registrant to designate one or more products that the registrant has added to the registrant's electronic gift registry as products that, once purchased by a gift giver, is shippable at any time, including before the critical date specified by the registrant, by interacting with the graphical user interface. In some implementations, interacting with the graphical user interface by the registrant to designate one or more products as products that are not to be shipped until after the critical date specified by the registrant to ship the products includes activating, by the registrant, a corresponding shipping hold option for each of the one or more products. In some implementations, the critical date and shipment designation for each of the one or more products included in the registrant's electronic gift registry is stored in the computer memory storage system that stores gift registry information for the registrant.

In a third aspect, implementations of the present disclosure provide a computer-implemented method of consummating a transaction including accessing, from a computer memory storage system, information about multiple different products that are available to be purchased from a retailer, the accessed information for each product including an initial price for the product, enabling display, at a computing system and to a potential purchaser, of a graphical user interface that presents indications of at least some of the different products that are available to be purchased from the retailer, receiving an indication of a selection by the potential purchaser of a particular product for which the indication is presented within the graphical user interface, the selection of the particular product having been achieved through interaction with the graphical user interface displayed at the computing system. In response to receiving the indication of the selection by the potential purchaser of the particular product, implementations of the present disclosure further provide for requesting payment from the potential purchaser of the initial price for the particular product, receiving payment information to cover the initial price for the particular product, the payment information having been provided by the potential purchaser through interaction with the graphical user interface displayed at the computing system. As a consequence of having received the indication of the selection by the potential purchaser of the particular product and having received the payment information to cover the initial price for the particular product, implementations of the present disclosure further provide for issuing a voucher to a voucher recipient, the voucher being redeemable for one of a credit towards another purchase in the amount of the initial price for the particular product and the particular product, recording, in the computer memory storage system, that the voucher recipient was issued the voucher redeemable for one of the credit towards another purchase in the amount of the initial price for the particular product and the particular product and after issuing the voucher to the voucher recipient, receiving an indication of a request by the voucher recipient to redeem the voucher. In response to receiving the request from the voucher recipient to redeem the voucher, implementations of the present disclosure further provide for accessing, from the computer memory storage system, the record that the voucher recipient was issued the voucher redeemable for one of the credit towards another purchase in the amount of the initial price for the particular product and the particular product, and accessing, from the computer memory storage system, information about the particular product. Based on the accessed record that the voucher recipient was issued the voucher and the accessed information about the particular product, implementations of the present disclosure further provide for determining that the price for the particular product has changed from the initial price to a new price, and enabling the voucher recipient to redeem the voucher for one of the credit towards another purchase in the amount of the initial price for the particular product and the particular product notwithstanding that the price for the particular product has changed from the initial price to the new price.

Implementations may include one or more of the following features. In some implementations, determining that the price for the particular product has changed from the initial price to the new price includes determining that the price for the particular product has changed from the initial price to a new price that is lower than the initial price, and enabling the voucher recipient to redeem the voucher for one of the credit towards another purchase in the amount of the initial price for the particular product and the particular product includes enabling the voucher recipient to apply the credit towards another purchase in the amount of the initial price for the particular product notwithstanding that the price for the particular product has changed from the initial price to the lower new price. In some implementations, receiving the indication of the request by the voucher recipient to redeem the voucher includes receiving the indication of the request by the voucher recipient to redeem the voucher for the particular product. In some implementations, determining that the price for the particular product has changed from the initial price to the new price includes determining that the price for the particular product has changed from the initial price to a new price that is lower than the initial price. In some implementations, enabling the voucher recipient to redeem the voucher for one of the credit towards another purchase in the amount of the initial price for the particular product and the particular product includes redeeming the voucher for the particular product, issuing the voucher recipient another credit in the amount of a difference between the initial price for the particular product and the lower new price for the particular product, and recording, in the computer memory storage system, that the voucher recipient was issued another credit in the amount of the difference between the initial price for the particular product and the lower new price for the particular product. In some implementations, the method further includes providing a notification to the voucher recipient that the voucher was issued. In some implementations, the notification includes the particular product for which the voucher was purchased, the name of the purchaser, and additional information related to a ship later to registrant option including item status and pricing information. In some implementations, the notification is one of an electronic mail message, a postal letter, and a Short Message Service text message. In some implementations, the method further includes in response to receiving the indication of the selection by the potential purchaser of the particular product, and before requesting payment from the potential purchaser of the initial price for the particular product, providing to the potential purchaser an indication that the voucher recipient has designated the item as ship later to registrant.

In a fourth aspect, implementations of the present disclosure provide a computer-implemented method of consummating a transaction that includes accessing, from a computer memory storage system, information about multiple different products that are available to be purchased from a retailer, the accessed information for each product including an initial price for the product, enabling display, at a computing system and to a potential purchaser, of a graphical user interface that presents indications of at least some of the different products that are available to be purchased from the retailer and receiving an indication of a selection by the potential purchaser of a particular product for which the indication is presented within the graphical user interface, the selection of the particular product having been achieved through interaction with the graphical user interface displayed at the computing system. In response to receiving the indication of the selection by the potential purchaser of the particular product, implementations of the present disclosure further provide for requesting payment from the potential purchaser of the initial price for the particular product. Implementations of the present disclosure further provide for receiving payment information to cover the initial price for the particular product, the payment information having been provided by the potential purchaser through interaction with the graphical user interface displayed at the computing system. As a consequence of having received the indication of the selection by the potential purchaser of the particular product and having received the payment information to cover the initial price for the particular product, implementations of the present disclosure further provide for issuing to a voucher recipient a voucher that is redeemable for one of a credit towards another purchase in the amount of the initial price for the particular product and the particular product and recording, in the computer memory storage system, that the voucher recipient was issued the voucher redeemable for one of the credit towards another purchase in the amount of the initial price for the particular product and the particular product. After issuing the voucher to the voucher recipient, implementations of the present disclosure further provide for receiving an indication of a request by the voucher recipient to redeem the voucher for a credit towards a purchase of another product that is different than the particular product. In response to receiving the request from the voucher recipient to redeem the voucher for the credit towards the purchase of the other product, implementations of the present disclosure further provide for comparing the initial price for the particular product to a current price of the other product, determining that the initial price for the particular product is greater than the current price of the other product, initiating order fulfillment of the other product, issuing the voucher recipient another credit in the amount of a difference between the initial price for the particular product and the current price of the other product, and recording, in the computer memory storage system, that the voucher recipient was issued another credit in the amount of the difference between the initial price for the particular product and the current price of the other product.

Implementations may include one or more of the following features. In some implementations, the method further includes providing a notification to the voucher recipient that the voucher was issued. In some implementations, the notification includes the particular product for which the voucher was purchased, the name of the purchaser, and additional information related to a ship later to registrant option including item status and pricing information. In some implementations, the notification is one of an electronic mail message, a postal letter, and a Short Message Service text message. In some implementations, the method further includes in response to receiving the indication of the selection by the potential purchaser of the particular product, and before requesting payment from the potential purchaser of the initial price for the particular product, providing to the potential purchaser an indication that the voucher recipient has designated the item as ship later to registrant.

In a fifth aspect, implementations of the present disclosure provide computer-implemented methods of managing an electronic gift registry including establishing an electronic gift registry for a registrant, receiving, from the registrant, selections of different products available for purchase from a retailer as products that are to be added to the electronic gift registry, and, for each of the different products, an indication of a quantity of the product that the registrant desires, storing, in a computer memory storage system, the received indications of the products added to the electronic gift registry by the registrant and the received indications of the quantity that the registrant desires of each product added to the electronic gift registry, accessing, from the computer memory storage system, information stored in the computer memory storage system related to one or more of the products that the registrant has added to the electronic gift registry, the accessed information for each product including an indication of a retail price for the product, an indication of the quantity of the product that the registrant desires, and an indication of a quantity of the product that has been purchased for the registrant off of the electronic gift registry, enabling display, at a computing system and to a potential purchaser, of a graphical user interface that presents indications of one or more of the different products that the registrant has added to the electronic gift registry, indications of the quantity of each of the one or more different products that the registrant desires, and indications of the quantity of each of the one or more different products that has been purchased for the registrant off of the electronic gift registry, and receiving an indication of a selection by the potential purchaser of a particular product that the registrant added to the electronic gift registry and for which the indication is presented within the graphical user interface, the selection of the particular product having been achieved through interaction with the graphical user interface displayed at the computing system. In response to receiving the indication of the selection by the potential purchaser of the particular product, implementations of the present disclosure further provide for requesting payment from the potential purchaser of the retail price for the particular product and receiving payment information to cover the retail price for the particular product, the payment information having been provided by the potential purchaser through interaction with the graphical user interface displayed at the computing system. As a consequence of having received the indication of the selection by the potential purchaser of the particular product and having received the payment information to cover the retail price for the particular product, implementations of the present disclosure further provide for issuing to the registrant a voucher that is redeemable for one of a credit towards another purchase in the amount of the retail price for the particular product and the particular product, recording, in the computer memory storage system, that the registrant was issued the voucher redeemable for one of the credit towards another purchase in the amount of the retail price for the particular product, and updating the stored indication of the quantity of the particular product that has been purchased for the registrant off of the electronic gift registry to reflect that an additional one of the particular product has been purchased for the registrant off of the electronic gift registry.

Implementations may include one or more of the following features. In some implementations, the method further includes providing a notification to the registrant that the voucher was issued. In some implementations, the notification includes the particular product for which the voucher was purchased, the name of the purchaser, and additional information related to a ship later to registrant option including item status and pricing information. In some implementations, the notification is one of an electronic mail message, a postal letter, and a Short Message Service text message. In some implementations, the method further includes in response to receiving the indication of the selection by the potential purchaser of the particular product, and before requesting payment from the potential purchaser of the initial price for the particular product, providing to the potential purchaser an indication that the registrant has designated the item as ship later to registrant. In some implementations, the method further includes after issuing the voucher to the registrant updating the computer memory storage system to reflect a change in inventory for the particular product.

The present disclosure further provides a system for implementing the methods provided herein. The system includes a computer memory storage system configured to store instructions, a display device, and one or more processors configured to execute the instructions from the computer memory storage system to perform operations in accordance with implementations of the methods provided herein.

The various aspects, implementations, and features disclosed may be implemented using, for example, one or more of a method, an apparatus, a system, tool, or processing device for performing a method, a program or other set of instructions, an apparatus that includes a program or a set of instructions, and a computer program stored on a tangible, computer-readable storage medium. The tangible, computer-readable storage medium may include, for example, instructions that, when executed, cause a computer to perform acts specified by the instructions.

The details of one or more implementations are set forth in the accompanying drawings and the description below. Other features will be apparent from the description and the drawings, and from the claims.

DETAILED DESCRIPTION

In one implementation, an online retailer provides a user with the ability to create and maintain a gift registry that communicates gift preferences of the user to interested purchasers or gift givers. For example, a gift registry can be used by expectant parents to communicate to friends and family members items they would like to receive before and/or after the birth of their baby. The expectant parents can register with the online retailer through the online retailer's web site, browse the web pages of the online retailer and place selected items available for sale through the online retailer in their gift registry. In addition, the online retailer may enable the expectant parents to name their gift registry and provide the name of the gift registry, the Uniform Resource Locator (URL) for the web site of the online retailer, or the name of the online retailer to friends, family members, and other potential gift givers. Subsequently, the gift givers can visit the online retailer's web site, access the named gift registry and select one or more items from the registry for purchase and shipment to the expectant parents.

In some situations, the expectant parents may prefer not to have items in their gift registry shipped to them until after the birth of their baby. For example, the expectant parents may be superstitious, believing that receiving a gift prior to the birth of their baby may be bad luck, or the expectant parents simply may not have sufficient storage capacity in their home to accommodate the twenty cases of diapers for which they have registered. Accordingly, the gift registry may provide the expectant parents, upon registering for products available from the online retailer, with the ability to designate when a registry item should be shipped after it is purchased. For example, the electronic registry may enable a registrant to designate an item in the registrant's registry as an item that is to be shipped immediately (or upon availability) when purchased. Alternatively, the electronic registry may enable a registrant to designate an item in the registrant's registry as an item to be held (e.g., not shipped), in which case, when the item is purchased for the registrant, the electronic registry may not fulfill the order for the item but, instead, the electronic registry may issue the registrant a voucher that later can be redeemed for the item and/or applied as a credit toward the purchase of another item.

Figure 1:
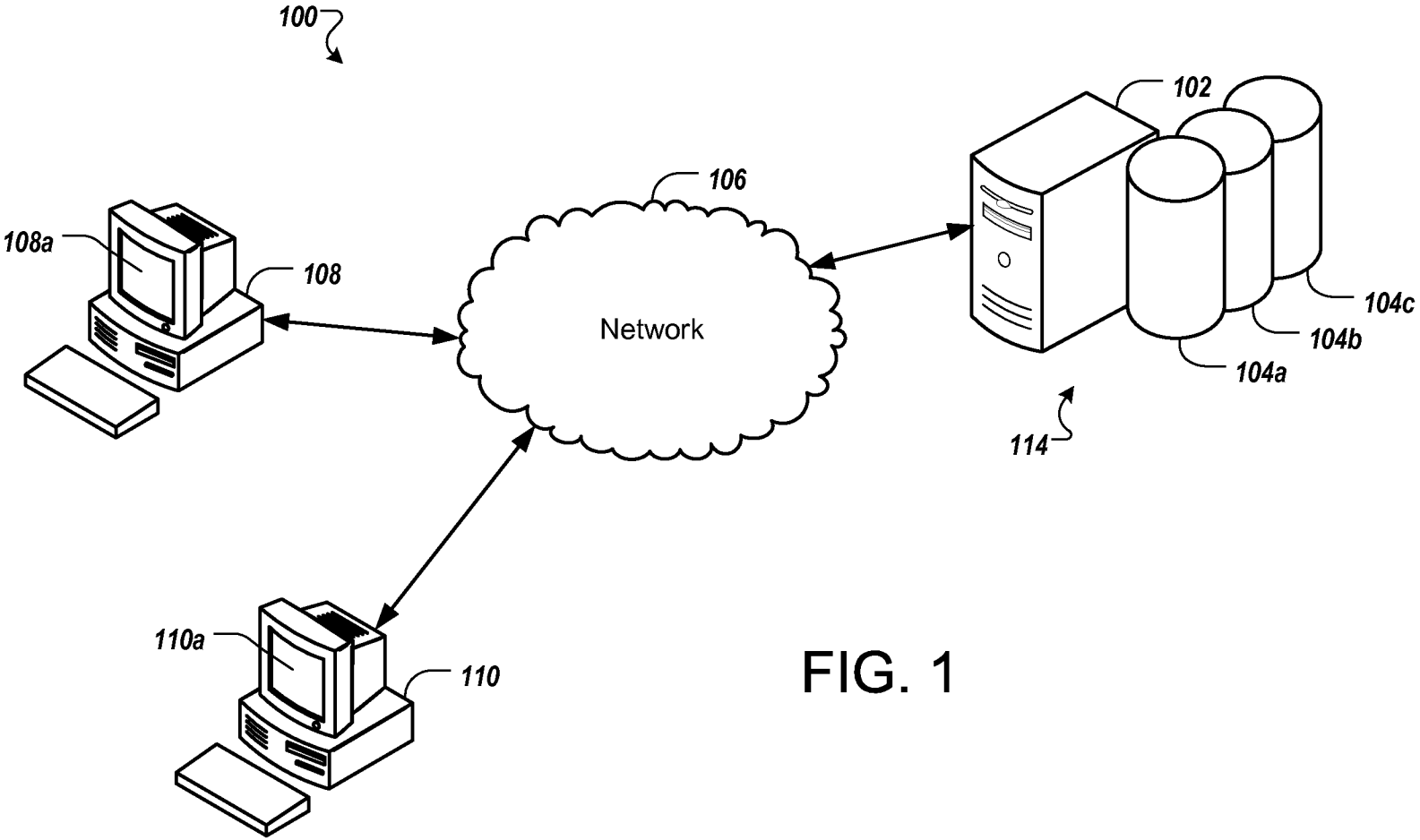
FIG. 1 is a diagram of an example of a network architecture that can be used in accordance with implementations of the present disclosure.

FIG. 1 is a diagram of an example of a network architecture 100 that can be used in accordance with implementations of the present disclosure. The architecture 100 includes clients 108, 110 and a computer system 114. The computer system 114 includes a server 102 and databases 104*a*, 104*b*, 104*c*. In some implementations, the architecture 100 represents a client/server system supporting multiple computer systems including one or more clients (e.g., clients 108, 110) and/or one or more servers (e.g., server 102) that are connectively coupled for communication with one another over a network 106. In some implementations, the clients (e.g., clients 108, 110) are directly connected to the one or more servers (e.g., server 102) (without connecting by way of network 106).

The clients 108, 110 can represent various forms of processing devices including, but not limited to, a general purpose computer, a special purpose computer, a desktop computer, a laptop computer, a handheld computer, a personal digital assistant (PDA), a cellular telephone, a network appliance, a camera, a smart phone, an enhanced general packet radio service (EGPRS) mobile phone, a media player, a navigation device, an email device, a game console, or a combination of any two or more of these data processing devices or other data processing devices. In addition, each client 108, 110 may access application software on the server 102.

The server 102 can represent various forms of servers including, but not limited to, a web server, an application server, a proxy server, a network server, or a server farm. For example, the server 102 can be an application server that executes software accessed by clients 108, 110. In operation, multiple clients (e.g., clients 108, 110) can communicate with the server 102 by way of network 106. In some implementations, architecture 100 may enable a user to invoke applications available on the server 102 using a web browser running on a client (e.g., clients 108, 110). Each application can individually access data from one or more repository resources (e.g., databases 104*a*, 104*b*, 104*c*). For example, the server 102 accesses databases 104*a*, 104*b*, 104*c*.

In some implementations, the client devices 108, 110 communicate wirelessly through a communication interface (not shown), which may include digital signal processing circuitry where necessary. The communication interface may provide for communications under various modes or protocols, such as Global System for Mobile Communications (GSM) voice calls, Short Message Service (SMS), Enhanced Messaging Service (EMS), or Multimedia Messaging Service (MMS)

messaging, Code Division Multiple Access (CDMA), Time Division Multiple Access (TDMA), Private Data Channel (PDC), Wideband Code Division Multiple Access (WCDMA), Code Division Multiple Access 2000 (CDMA2000), or General Packet Radio Service (GPRS), among others. For example, the communication may occur through a radio-frequency transceiver (not shown). In addition, short-range communication may occur, such as using a Bluetooth (e.g., IEEE 802.15x), WiFi (e.g., 802.11x), or other such transceivers.

In some implementations, the architecture 100 is a distributed client/server system that spans one or more networks such as network 106. The network 106 can be a large computer network, such as a local area network (LAN), wide area network (WAN), the Internet, a cellular network, or a combination thereof connecting any number of mobile clients, fixed clients, and servers. In some implementations, each client (e.g., clients 108, 110) communicates with the server 102 via a virtual private network (VPN), Secure Shell (SSH) tunnel, or other secure network connection. In some implementations, the network 106 includes the Internet, a wireless service network and may include the Public Switched Telephone Network (PSTN). In other implementations, the network 106 includes a corporate network (e.g., an intranet) and one or more wireless access points.

Each client (e.g., clients 108, 110) can establish its own session with the server 102. Each session can be semi-permanent as it can be established at one point in time and torn down at another. Each session can involve two-way information exchange between the computer system 114 and each individual client 108, 110. For example, a Hypertext Transfer Protocol (HTTP) session enables the association of information with individual users. A session can be stateful where at least one of the communicating parts (e.g., the server 102 or the client (e.g., clients 108, 110)) can save information about the session history in order to be able to communicate. Alternatively, stateless communication, which includes independent requests with associated responses, may be employed.

Multiple clients (e.g., clients 108, 110) can communicate via network 106 with the server 102. In order to run an application, each client (e.g., clients 108, 110) can establish a corresponding session with the application server 102. For example, a consumer, using client 108, can establish a communication session with server 102 by way of network 106. The server 102 can be a web server that hosts an online retail web site. The consumer can invoke web pages for the online retail web site using a web browser running on the client 108. The consumer can register with the online retail web site, create a gift registry, and browse the web site to select items for inclusion in the consumer's gift registry.

In some implementations, database 104*a* may be a repository that stores information related to the goods that are made available for sale via the web pages of the online retail web site. Database 104*b* may be a repository that stores information about consumers who have registered with the online retail web site (e.g., the registered consumers' unique identification (ID) and passwords, shipping addresses, phone numbers, electronic mail (email) addresses, mobile phone numbers (e.g., for receiving SMS text messages), etc.). Database 104*c* may be a repository that stores gift registry information for each registered consumer (registrant) having a gift registry (e.g., gift registry name, recipient, items included in the gift registry, shipment options for each item in the gift registry, shipping address for the recipient, etc.).

In some implementations, additional databases may be included in the computer system 114 to supply repositories for storing additional information for a registered consumer of an online retail web site. For example, additional databases may store billing information (e.g., billing address, credit card account number) and personal information (e.g., marital status, number, ages and gender of children, etc.) for a registered consumer. The online retail web site may use such additional stored information to customize and simplify the consumer's shopping experience with the online retail web site.

Figure 2:
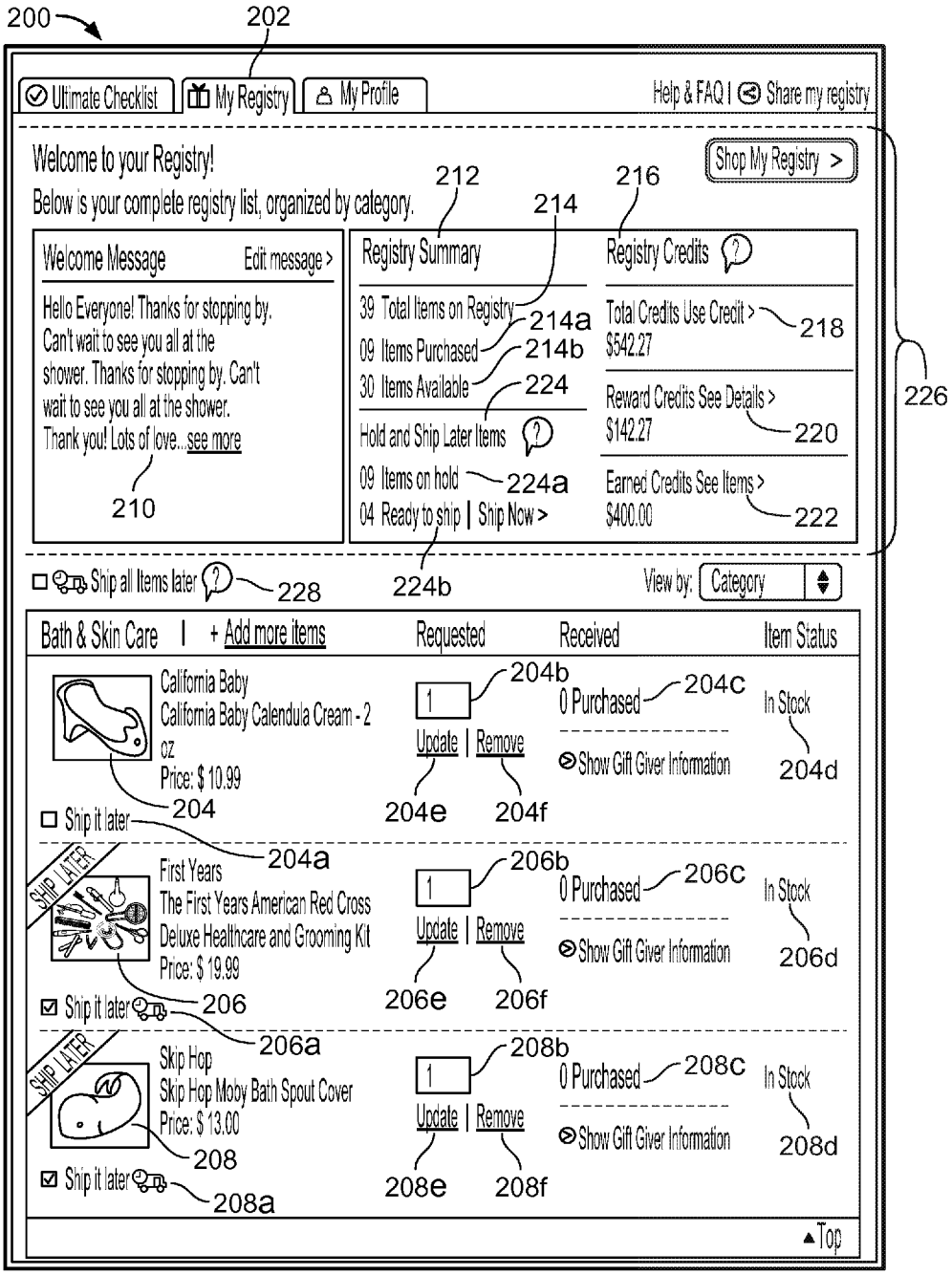
FIG. 2 is a screen-shot illustrating an example of a gift registry web page showing items selected by a registrant for inclusion in the registrant's gift registry.

FIG. 2 is a screen-shot 200 illustrating an example of a gift registry web page 202 that shows items selected by a registrant for inclusion in the registrant's gift registry. As described previously, a consumer can register with an online retail web site. For example, the registration process may include establishing a user ID and password for providing the consumer with secure access to the consumer's personal account. Once established by the online retail web site as a registered consumer, the online retail web site may enable the consumer to log into the consumer's personal account on the web site and establish a gift registry. The online retail web site then may enable the registrant to browse the web pages of the online retail web site and select items to be included in the registrant's gift registry. Screen shot 200 shows the registry web page 202 with items 204, 206, 208 as previously having been selected by the registrant for inclusion in the registrant's gift registry.

Referring to FIG. 1, in some implementations, a consumer can run a web browser on client 108 and connect to the web server 102 by way of the network 106. The consumer can access an online retail web site using the web browser. For example, the client 108 can display web pages that include a graphical user interface (GUI) on display device 108*a* that allow the consumer to register with the online retailer and establish a gift registry. The registration information provided by the consumer can be stored in database 104*b*. The registrant can browse web pages for the online retailer that display in a GUI on display device 108*a* for goods for sale included in database 104*a*. The registrant can select items for inclusion in the registrant's gift registry (e.g., items 204, 206, 208) and specify a shipping hold option 204*a*, 206*a*, 208*a*, respectively, for each item included in the gift registry. The server 102 can store the gift registry items and the specified shipping hold options for the registrant in database 104*c*.

The shipping hold option allows a registrant to designate a registry item as a registry item that, when an order is placed for it on behalf of the registrant, the order should not be fulfilled immediately. In some implementations, instead of fulfilling the order for the registry item right away, the electronic gift registry may issue the registrant a voucher for the registry item that can be redeemed later for the registry item or applied as a credit toward the purchase of another item available through the electronic gift registry. As illustrated in FIG. 2, the registrant selected item 204 for inclusion in the registrant's gift registry, but the registrant has not selected the shipping hold option 204*a* for item 204. Therefore, when a gift giver selects item 204 for purchase from the gift registry, the online retailer will ship item 204 to the registrant at the time of purchase (assuming it is in stock and available for shipping). In another example, the registrant selected the shipping hold option 206*a* for item 206. Therefore, when a gift giver selects item 206 for purchase from the gift registry, the online retailer will not ship item 206 to the registrant immediately upon purchase, even if item 206 is in stock and available for shipping. Instead, the online retailer will grant the registrant a voucher that the registrant later can redeem for the item. In some implementations, web page 202 may enable the registrant to select shipping hold all option 228 that activates the shipping hold option for all items in the gift registry.

In some implementations, when an item is selected for purchase from the gift registry, the online retail web site informs the registrant of the purchase (e.g., the online retail web site generates and sends an email message to the registrant's registered email address, the online retail web site generates and sends an SMS text message to the registrant's registered mobile phone, etc.). In such implementations, the registrant is informed that an item, where the shipping hold option was not selected (e.g., item 204), will be shipped (if available and in stock) at the time of purchase. In addition, the registrant also is informed that an item, where the shipping hold option was selected (e.g., item 206), will not be shipped to the registrant until the registrant indicates that the item should be shipped by redeeming a voucher for the item. In some cases, the registrant will receive notice of items purchased by a gift giver for direct shipment to the registrant, but the registrant will not receive notice of items purchased by a gift giver for shipment to the gift giver (e.g., the gift giver may want to surprise the registrant with the items).

As illustrated in FIG. 2, web page 202 enables the registrant to include a plurality of items in the registrant's gift registry with the shipping hold option for the different items being different. For example, shipping hold options 206*a* and 208*a* have been specified for items 206 and 208, but shipping hold option 204*a* has not been specified for item 204.

Additionally, web page 202 enables the registrant to specify the quantity of each selected item the registrant would like to receive using, for example, requested item number input fields 204*b*, 206*b*, 208*b* for items 204, 206, 208, respectively. For example, web page 202 enables the registrant to enter the desired quantity for an item in the gift registry in the requested item number input field and activate an update control to update the requested quantity of the item. Specifically, update controls 204*e*, 206*e*, 208*e* can update the item quantity entered in the requested item number input fields 204*b*, 206*b*, 208*b* for items 204, 206, 208, respectively. Additionally, web page 202 enables the registrant to remove an item from the gift registry. Specifically, web page 202 provides remove controls, which enable the registrant to remove items from the gift registry. For example, the registrant can utilize remove controls 204*f*, 206*f*, 208*f* to remove items 204, 206, 208, respectively, from the gift registry. The server 102 can update the information for the registrant included in databases 104*b*, 104*c* (e.g., item quantities, removal of an item from the gift registry) based on the selections made in the GUI of the web page 202.

The web page 202 also includes indications of the quantities of each included item that already have been purchased for the recipient from the gift registry. For example, number of items purchased indicators 204*c*, 206*c*, 208*c* reflect the quantity of items 204, 206, 208, respectively, that already have been purchased for the registrant. The web page 202 also includes item status indicators 204*d*, 206*d*, 208*d* reflecting the current item status for items 204, 206, 208, respectively, indicating, for example, if the item is currently in stock, on back order, unavailable (e.g., discontinued) or if previous quantities of the item have already been shipped to the recipient. The server 102 can provide the entry data for the number of items purchased indicators 204*c*, 206*c*, 208*c* for the registrant from information stored in databases 104*b*, 104*c* for the registrant. The server 102 can provide the entry data for the item status indicators 204*d*, 206*d*, 208*d* from information stored for the items 204, 206, 208, respectively, in database 104*a*.

The web page 202 includes a registry dashboard 226 that includes an input field 210, a registry summary 212 and registry credits 216. The registrant can enter a welcome message in the input field 210 that is displayed when a purchaser (gift giver) accesses the recipient's gift registry. The registry summary 212 includes total items indicator 214, which indicates the total number of items currently in the gift registry. In some implementations, the total number of items currently in the gift registry, as shown by the total items indicator 214, may be the sum of the items purchased from the registry as shown by an items purchased indicator 214*a* and the items available for purchase (but not yet purchased) in the registry as shown by an items available for purchase indicator 214*b*.

The registry credits 216 reflect dollar amounts credited to the registrant. The online retail web site enables the registrant to use the registry credits 216 to purchase items in the registrant's gift registry as well as to purchase additional items from the online retail web site not included in the registrant's gift registry. In some implementations, total registry credits 218 may reflect the sum of reward credits 220 and earned credits 222. For example, the online retail web site may grant the registrant reward credits 220 when a gift giver selects a particular registry item for purchase. In another example, the online retail web site may grant the registrant reward credits 220 when the total dollar amount of purchases for a particular timeframe exceeds a predetermined amount. For instance, the online retail web site may grant a registrant earned credits 222 where a specific dollar amount (e.g., five percent of the purchase total) is credited to the earned credits 222 each time a purchaser purchases one or more registry items.

The web page 202 includes a hold and ship later items summary 224. The summary 224 includes the number of registry items for which the shipping hold option has been selected (items on hold shown by hold indicator 224*a*). Additionally, the summary 224 includes the number of registry items where the shipping hold option for the item is selected and a purchaser has purchased a voucher for the item making it available for redemption and shipment (ready to ship indicator 224*b*) upon authorization by the registrant.

Referring to FIG. 1, the web page 202 can be displayed to the registrant on display device 108*a* of client 108. The information displayed in the registry summary 212 and the registry credits 216 can be stored for a registrant in databases 104*b*, 104*c*. The server 102 can access the databases 104*b*, 104*c* to populate the item numbers in the registry summary 212 for each of the indicators (total items indicator 214, items purchased indicator 214*a*, items available for purchase indicator 214*b*, hold indicator 224*a*, and ready to ship indicator 224*b*). Additionally, the server 102 can access the databases 104*b*, 104*c* to populate the item numbers in the registry credits 216 for each of the indicators (total registry credits 218, reward credits 220 and earned credits 222).

Figure 3A:
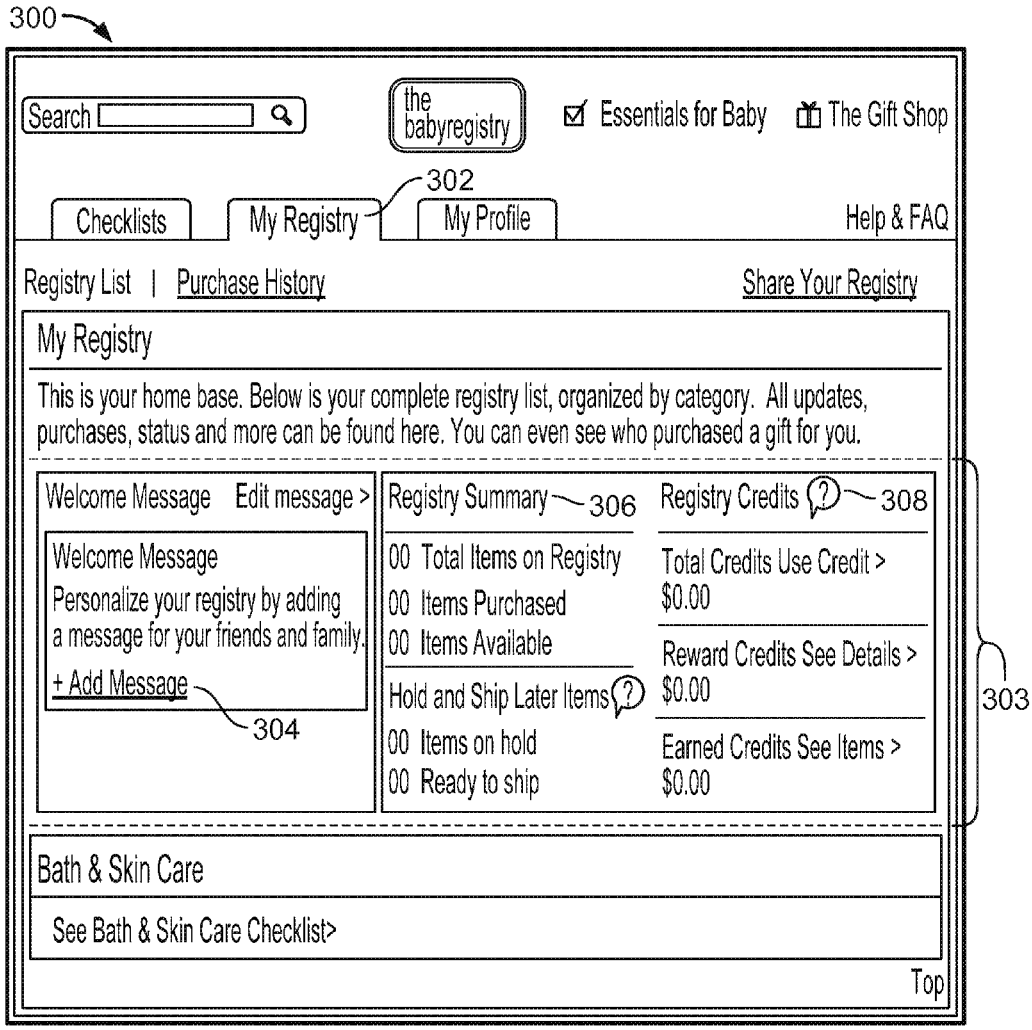
FIG. 3A is a screen-shot illustrating an example of an introductory web page for a gift registry.

FIG. 3A is a screen-shot 300 illustrating an example of an introductory web page 302 for a gift registry. Referring to FIG. 1, in some implementations, a consumer can run a web browser on client 108 and connect to the web server 102 by way of the network 106. The consumer can access an online retail web site using the web browser. The consumer can navigate the web site to the web page that allows the consumer to create a gift registry. The consumer can create a gift registry by providing user credentials (e.g., a user ID and password) that allow the user to create a gift registry. The server 102 can store the user credentials for the gift registry in database 104*b*.

Once the consumer creates the gift registry, the consumer can provide additional information for the set up of the gift registry (e.g., provide a name for the gift registry, indicate a default address for shipment of purchased items from the gift registry, etc.). The server 102 can store this additional information for the consumer in database 104*b*.

Thereafter, the server 102 may cause display device 108*a* to display a web page such as, for example, web page 302.

Web page 302 includes an initial registry dashboard 303 that includes an input field 304, a registry summary 306 and registry credits 308. Web page 302 enables the registrant to enter a customized welcome message in the input field 304 to be displayed when a purchaser accesses the recipient's gift registry. The registry summary 306 and registry credits 308 show zero amounts and there are no items currently included in the gift registry as the registrant just created and set up the gift registry. The server 102 can store the additional gift registry information (e.g., welcome message, etc.) in database 104*b*. The server 102 can subsequently retrieve the gift registry information stored in database 104*b* when the registrant or a purchaser wishes to access the gift registry.

For example, an expectant mother may set up a gift registry with the online retail web site months before the delivery of her baby. In such a case, the registrant may select items to place in the gift registry for subsequent purchase by gift givers or by the registrant herself. Purchasers can access the registrant's gift registry and select items for purchase at any time subsequent to the set up of the gift registry. In some implementations, the purchaser may purchase one or more items in the gift registry prior to the birth of the registrant's baby. It may be beneficial to receive some of the items in the registry prior to the birth of the baby (e.g., receiving blankets, an infant car seat, a stroller, etc.). However, in some cases, the registrant may prefer not to receive particular items in the gift registry until after the birth of her baby (e.g., diapers, formula, baby bottles, etc.). Additionally, the registrant may prefer to decide when the purchased registry gift is shipped to her from the online retailer. As described in connection with FIG. 2, the online retail web site enables the registrant to select the shipping hold option to instruct the online retail web site to hold an item for shipment until a voucher for the item is redeemed for the item. The registrant can then determine when the online retailer will ship the item to the registrant. At the time of purchase of one or more vouchers for one or more items as well as the purchase of the items themselves, the online retailer charges the purchaser for the price of all items and vouchers selected at the time of purchase, bills the purchaser for the total purchase amount and collects payment from the purchaser for the total purchase amount whether or not the online retailer ships the item to the registrant at the time of purchase.

Figure 3B:
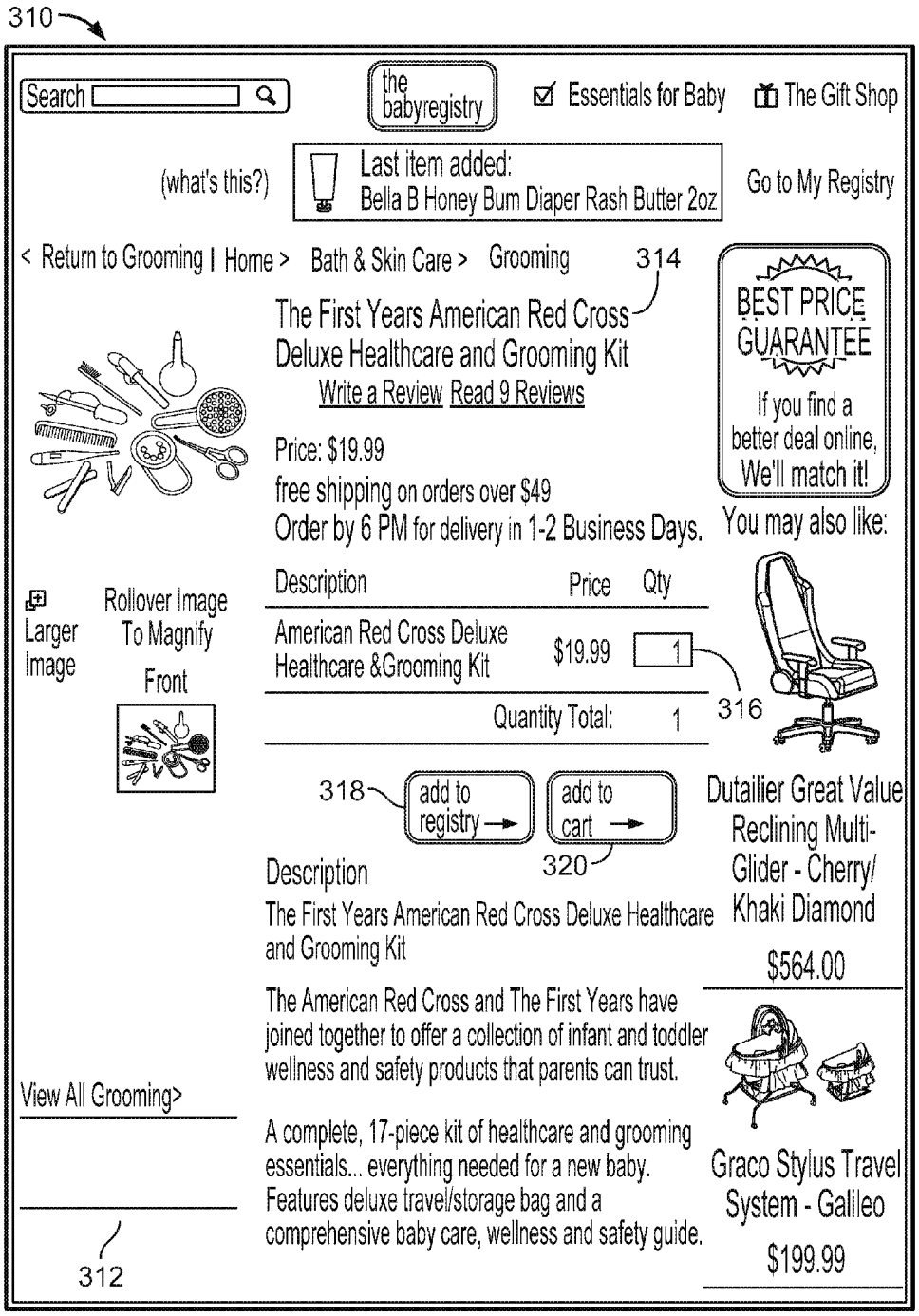
FIG. 3B is a screen-shot illustrating an example of a product web page for an item.

FIG. 3B is a screen-shot 310 illustrating an example of a product web page 312 for an item. Referring to FIG. 1, in some implementations, a consumer can run a web browser on the client 108 and connect to the web server 102 by way of the network 106. Specifically, the consumer can access an online retail web site using the web browser and browse the web site for products and services. The available products and services for the online retailer can be stored in database 104*a* for access by server 102. For example, a registrant can access the online retail web site and shop for products to include in the registrant's gift registry. The registrant can select a particular product (e.g., product 314) and the client 108 can display web page 312 for the product 314 on display device 108*a*, thereby enabling the registrant to enter the quantity of the item desired in a quantity input field 316.

The web page 312 includes an add to registry button 318 and an add to cart button 320. When the registrant activates the add to cart button 320, the designated quantity of the product 314 is placed in the online shopping cart for the registrant for immediate purchase. In some implementations, the online retailer may maintain the contents of the registrant's online shopping cart for a finite period of time (e.g., storing the contents of the online shopping cart for the registrant in databases 104*b*, 104*c*). The contents of the registrant's online shopping cart are available only to the registrant.

When the registrant activates the add to registry button 318, the designated quantity of the product 314 is added to the registrant's gift registry. For example, the server 102 updates database 104*c* by adding the additional item (product 314) in the designated quantity to the registrant's stored gift registry.

Figure 3C:
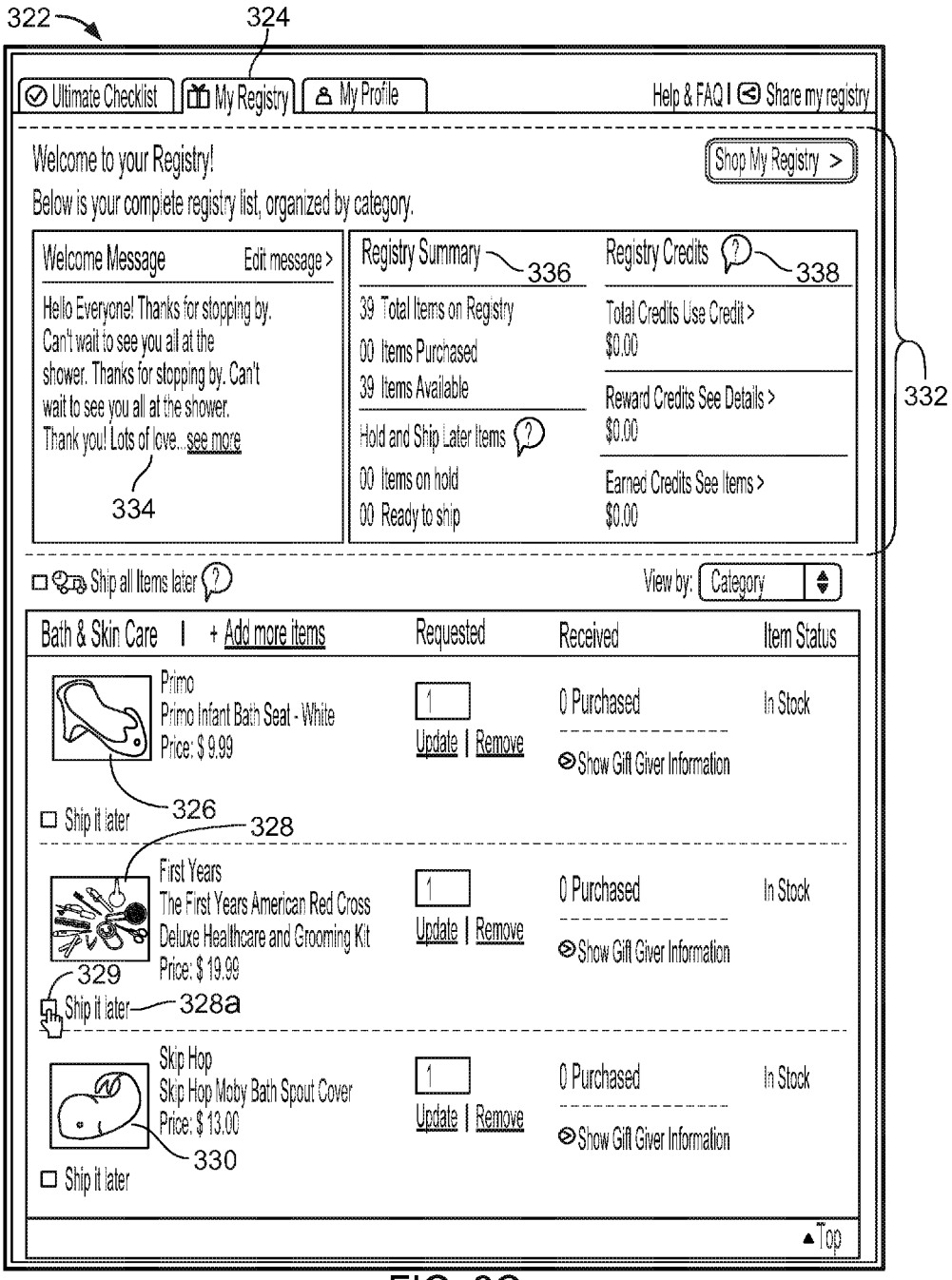
FIG. 3C is a screen-shot illustrating an example of a web page for a gift registry that includes one or more items.

FIG. 3C is a screen-shot 322 illustrating an example of a web page 324 for a gift registry that includes items 326, 328, 330. Referring to FIG. 1, in some implementations, a registrant can run a web browser on client 108 and connect to the web server 102 by way of the network 106. The registrant can access an online retail web site using the web browser. The registrant can then access the registrant's gift registry with the online retail web site. For example, the registrant can access a web page included in the online retail web site that enables the registrant to log into the registrant's gift registry using credentials established during set up of the registry (as described in FIG. 3A). The server 102 receives the credentials and verifies the credentials by comparing them to the credentials stored for the registrant in the database 104*b*. Upon verification, the server grants the registrant access to the registrant's gift registry and, for example, causes client 108 to display web page 324 on display device 108*a*.

The web page 324 includes registry dashboard 332 that includes input field 334, registry summary 336 and registry credits 338. The registry dashboard 332 is equivalent to the registry dashboard 226 described with reference to FIG. 2. The web page 324 includes item 328 added to the registry by the registrant as described in FIG. 3B. As described previously, web page 324 enables the registrant to select the shipping hold option 328*a* for the item 328 by activating a check box 329.

In some implementations, a registrant can select the shipping hold option for an item and later decide they want to remove the item from the ship later program. Thus, web page 324 enables the registrant to deactivate the shipping hold option for the item (e.g., deactivate the check box 329 for the shipping hold option 328*a*).

Figure 3D:
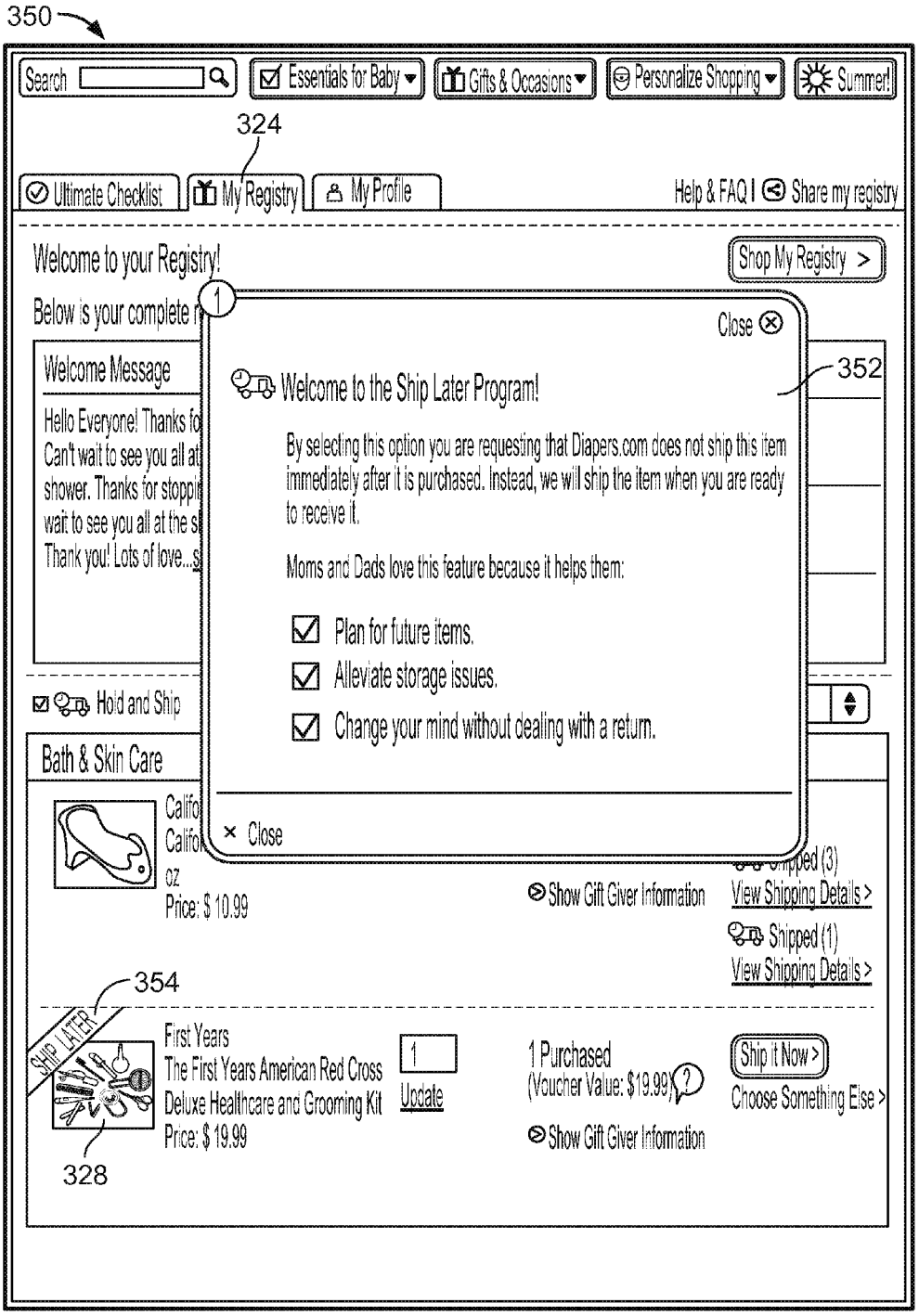
FIG. 3D is a screen-shot illustrating an example of a pop-up window for a gift registry.

FIG. 3D is a screen-shot 322 illustrating an example of a pop-up window 352 for a gift registry. Continuing with the example of FIG. 3C, when the registrant selects the shipping hold option 328*a* for item 328, if this is the first time the registrant has selected the shipping hold option for an item in the gift registry, the client 108 displays pop-up window 352 over the web page 324 on display device 108*a*. The pop-up window 352 includes information explaining the shipping hold option and its potential benefits. In addition, a ship later banner 354 is placed over the item 328 selected for inclusion in the ship later program on the web page 324. Additionally, the item 328 can be highlighted on the web page 324 for display on display device 108*a*.

As the registrant continues to select the shipping hold option for additional items included in the registrant's gift registry, pop-up windows explaining the ship later program may not be displayed repeatedly. However, a ship later banner may be placed over each item selected for inclusion in the ship later program and/or the item may be highlighted on the web page for display.

In some implementations, the online retail web site may enable the registrant to specify a date after which items included in the ship later program can be shipped to the registrant without the need for specific instructions from the registrant to do so. In such implementations, on the designated date, the online retailer automatically may redeem vouchers purchased for items and, thereafter, ship the items to the registrant. For example, an expectant mother (the registrant) and her spouse may have purchased a new home and have a move-in date that is one month after her expected due date. Therefore, the registrant can specify a shipping date that is after the scheduled move-in date.

Figure 4A:
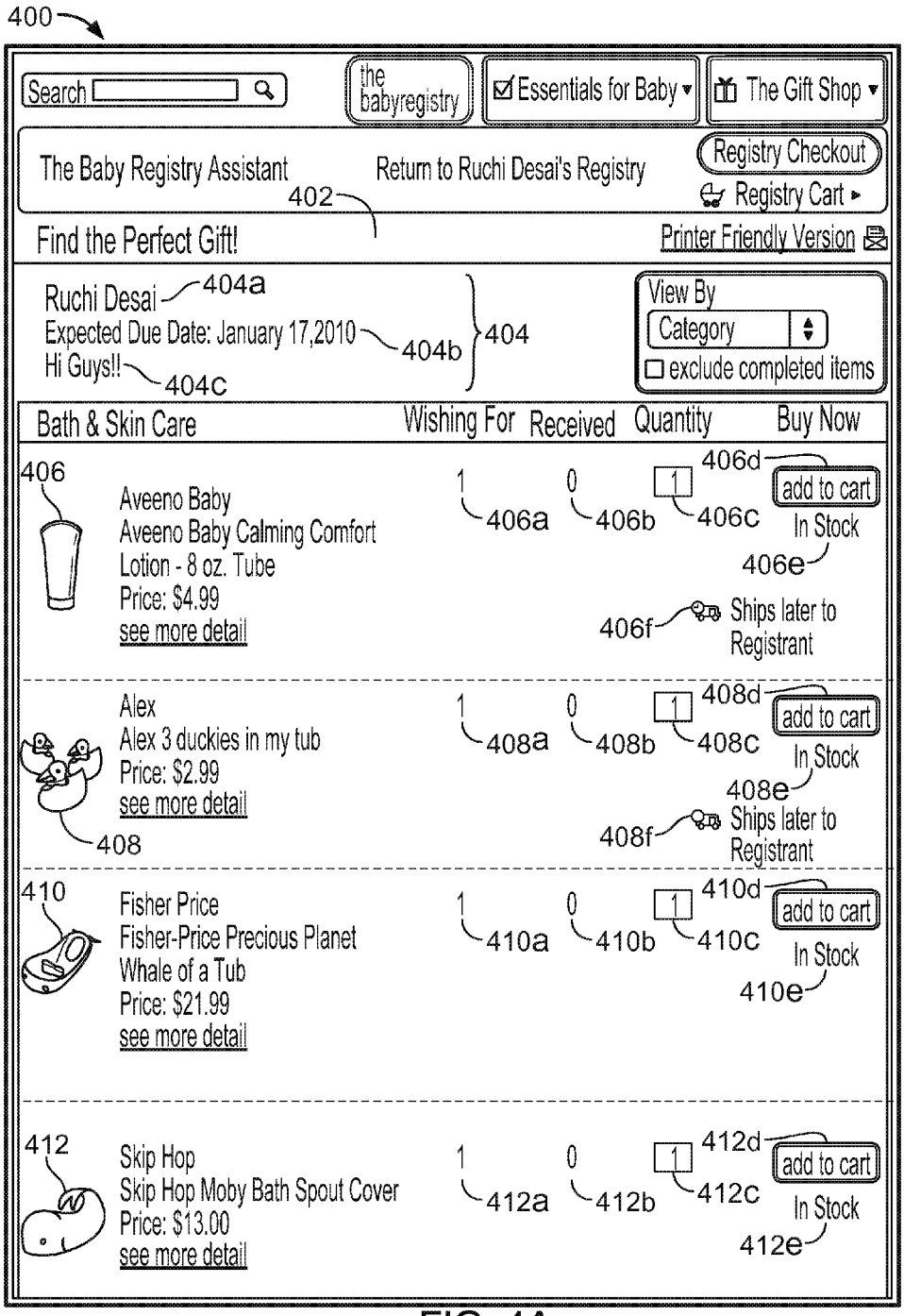
FIG. 4A is a screen-shot illustrating an example of a purchaser web page for a gift registry.

FIG. 4A is a screen-shot 400 illustrating an example of a purchaser web page 402 for a gift registry. For example, the purchaser (gift giver) may be a friend or family member wishing to purchase a gift for an expectant mother who has established a gift registry with an online retailer. Referring to FIG. 1, in some implementations, the purchaser can run a web browser on client 110 and connect to the web server 102 by way of the network 106. Using the web browser, the purchaser then can access the online retail web site that includes the gift registry for the expectant mother. For example, the purchaser can access a web page included in the online retail web site that enables the purchaser to enter the name of the expectant mother (or a name for the gift registry) in order to access the gift registry. The server 102 receives the name of the expectant mother (or the name of the gift registry) and accesses database 104*b* to determine if a gift registry exists for the named individual. If there is a gift registry for the expectant mother (e.g., Ruchi Desai living in Minnesota), the client 110 can display web page 402 to the purchaser (e.g., Ruchi's friend Jane who lives in Massachusetts) on display device 110*a* using information it receives from the server 102. The server 102 retrieves information for the web page from databases 104*a*, 104*b*, 104*c*.

The web page 402 includes a message area 404 that can include the name of the expectant mother (or registrant) (registrant name 404*a*), the expectant mother's due date (expected due date 404*b*), and a welcome message 404*c*. The registrant can enter the welcome message 404*c* in input field 210 as described in FIG. 2 for display on web page 402 as welcome message 404*c*. The web page 402 includes items 406, 408, 410, 412, which the registrant has added to the registrant's registry. In addition, the web page 402 shows the quantity of each item for which the registrant has registered that the registrant wishes to receive via "Wishing For" indicators 406*a*, 408*a*, 410*a*, 412*a* for items 406, 408, 410, 412, respectively. The web page 402 also shows the quantities of each item for which the registrant has registered that already have been purchased for the registrant via "Received" indicators 406*b*, 408*b*, 410*b*, 412*b* for items 406, 408, 410, 412, respectively.

A purchaser can enter the number of a particular item the purchaser would like to purchase for the registrant in quantity input fields 406*c*, 408*c*, 410*c*, 412*c* for items 406, 408, 410, 412, respectively. In response to activation of one or more of "Add to Cart" buttons 406*d*, 408*d*, 410*d*, 412*d* for items 406, 408, 410 412 respectively, web page 402 causes the designated quantity of the item to be added to an online shopping cart for subsequent purchase by the purchaser. For example, if a purchaser enters "1" in the quantity input field 406*c* and then activates the add to cart button 406*d*, web page 402 will add one of item 406 to the purchaser's online shopping cart for subsequent purchase. Item status indicators 406*e*, 408*e*, 410*e*, 412*e* indicate the current status of items 406, 408, 410, 412, respectively. Item status indicators may indicate whether the associated item is currently in stock, on back order, or unavailable (e.g., discontinued).

Web page 402 may display a "Ships Later to Registrant" icon (e.g., icons 406*f*, 408*f* for items 406, 408, respectively) to indicate to the purchaser that the registrant has opted not to have a particular item shipped immediately allowing the purchaser to purchase a voucher for the item that can later be redeemed by the registrant for the item such that the item is shipped to the registrant at a date that is more convenient for the registrant. An example of a registrant selecting the shipping hold option for a registry item is described with reference to FIG. 3C.

In some implementations, if a purchaser selects and purchases a voucher for an item designated as a ship later to registrant item, the online retail web site will notify the registrant of the voucher purchase. However, the online retailer may not ship the item immediately. For example, when the purchasing process is complete, the server 102 will update databases 104*a*, 104*b*, 104*c*. Database 104*a* can be updated to reflect a change in inventory for the purchased item. Database 104*c* can be updated to reflect the purchase of a voucher for the item in the information stored for the gift registry. The server 102 can access information in the database 104*b* to determine contact information for the registrant in order to notify the registrant of the registry purchase. The notification can include the item for which a voucher was purchased, the name of the purchaser, and additional information related to the ship later to registrant option including item status and pricing information. For example, the contact information can be a physical mailing address, an electronic mailing address (email address), or a telephone number. The notification can be an email message, a postal letter or an SMS text message.

In some implementations, the purchaser can select one or more items to add to the purchaser's shopping cart. For example, the purchaser can activate the add to cart button 406*d* to add the item 406 to the purchaser's shopping cart, which, as indicated by icon 406*f*, will ship sometime after the purchase of a voucher for the item as determined by the registrant. The purchaser can also activate the add to cart button 412*d* to add the item 412 to their shopping cart. Item 412 is in stock as shown by item status indicator 412*e*.

Additionally, the item 412 has not been selected for the ship later program. Therefore, since the item 412 is in stock, the online retailer will queue item 412 to be shipped to the registrant upon purchase.

Figure 4B:
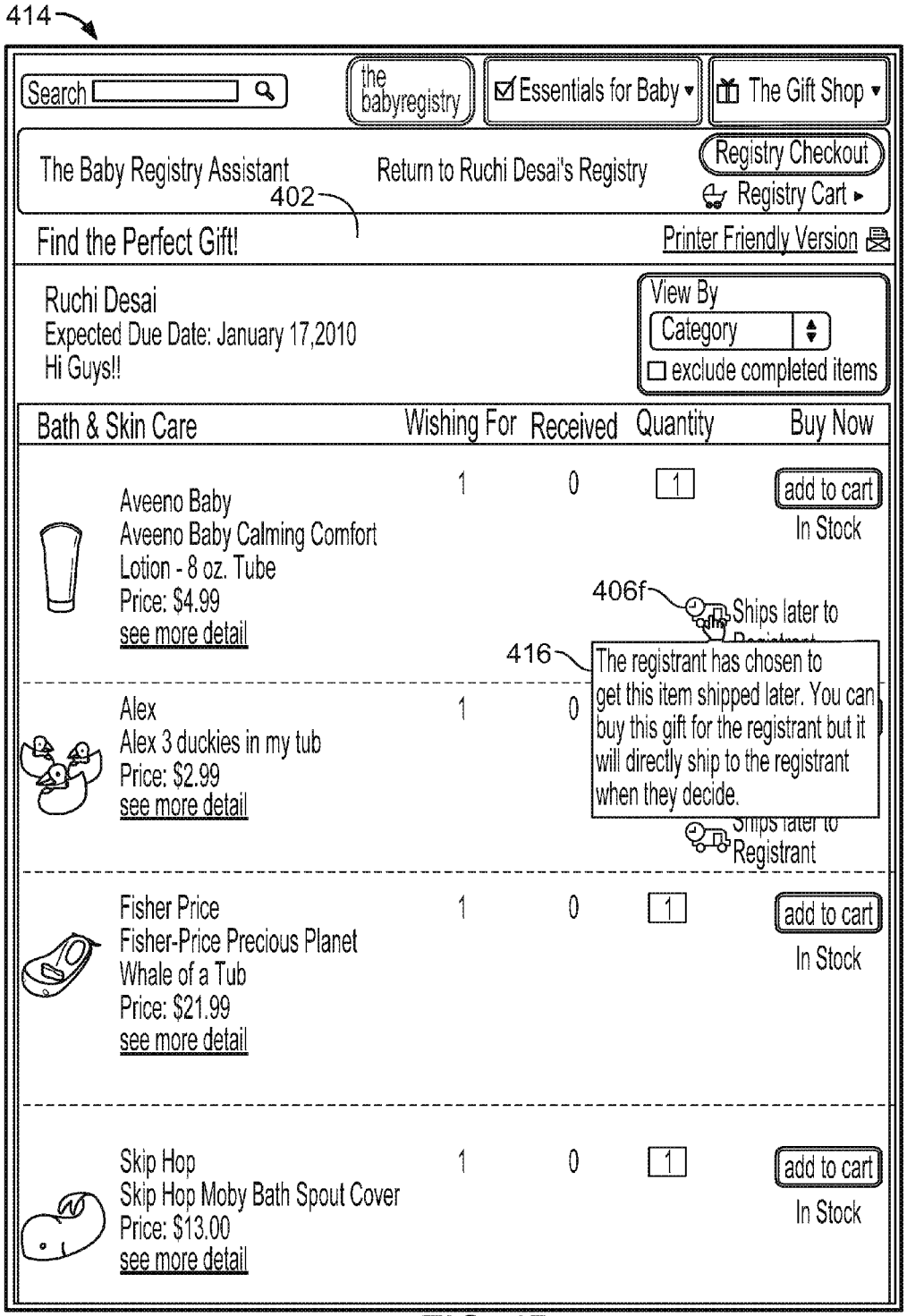
FIG. 4B is a screen-shot illustrating an example of a purchaser web page for a gift registry that includes an information pop-up window.

FIG. 4B is a screen-shot 414 illustrating the example of a purchaser web page 402 for a gift registry that includes an information pop-up window 416. Continuing with the example of FIG. 4A, the client 110 can display the web page 402 to the purchaser on display device 110*a* using information it receives from the server 102. In response to detecting that the purchaser is causing a cursor associated with a pointing device to hover over the icon 406*f*, web page 402 causes pop-up window 416 to be displayed over web page 402. As illustrated in FIG. 4B, the pop-up window 416 may include information explaining to the purchaser the meaning of the "ship later to registrant" option. In some implementations, the pop-up window 416 may include a link to another web page for the online retailer web site that may explain in more detail the meaning of the "ship later to registrant" option. In some implementations, the additional information provided to the purchaser regarding the ship later to registrant option can explain to the purchaser that the registrant can convert the voucher value of a purchased voucher for the item to registry credits. The registrant can use the registry credits to purchase another item instead of the item for which the voucher was purchased.

Figure 4C:
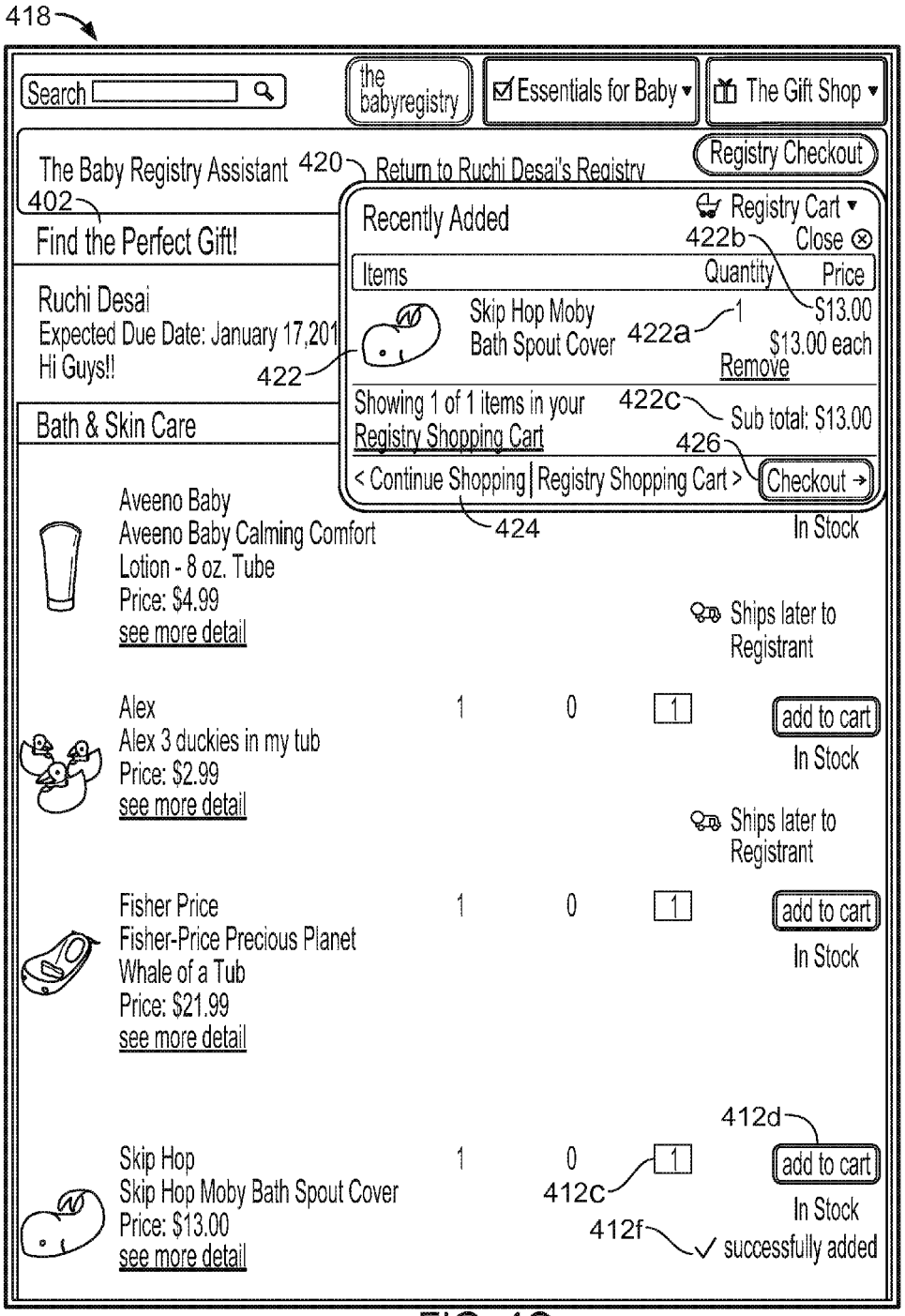
FIG. 4C is a screen-shot illustrating an example of a purchaser web page for a gift registry that includes a registry cart pop-up window.

FIG. 4C is a screen-shot 418 illustrating the example of a purchaser web page 402 for a gift registry that includes a registry cart pop-up window 420. Continuing with the example of FIGS. 4A and 4B, the client 110 can display the web page 402 to the purchaser on display device 110*a* using information it receives from the server 102. The purchaser can activate the add to cart button 412*d* which adds the item 412 in the quantity entered in the quantity input field 412*c* to the purchaser's online shopping cart resulting in the display of pop-up window 420 on web page 402. As illustrated in FIG. 4C, item 412 is not designated as ship later to registrant. Therefore, when the purchaser activates the "Add to Cart" button 412*d* for the item 412, the item 412 is immediately placed into the purchaser's online shopping cart.

Pop-up window 420 reflects the entry of the recently added item 412 into the shopping cart (cart item 422) in the quantity indicated in the quantity input field (cart item quantity 422*a*). The pop-up window 420 also shows a unit price 422*b* for the cart item 422 and a subtotal cost for the total quantity of the item ordered (subtotal 422*c*). Additionally, the web page 402 includes the shopping cart addition indicator 412*f* indicating that the online retail web site successfully added item 412 to the purchaser's online shopping cart. The purchaser can continue shopping by selecting the continue shopping option 424 in the pop-up window 420. Alternatively, the purchaser can activate the checkout button 426 in the pop-up window 420 to proceed to their online shopping cart for check out.

Figure 4D:
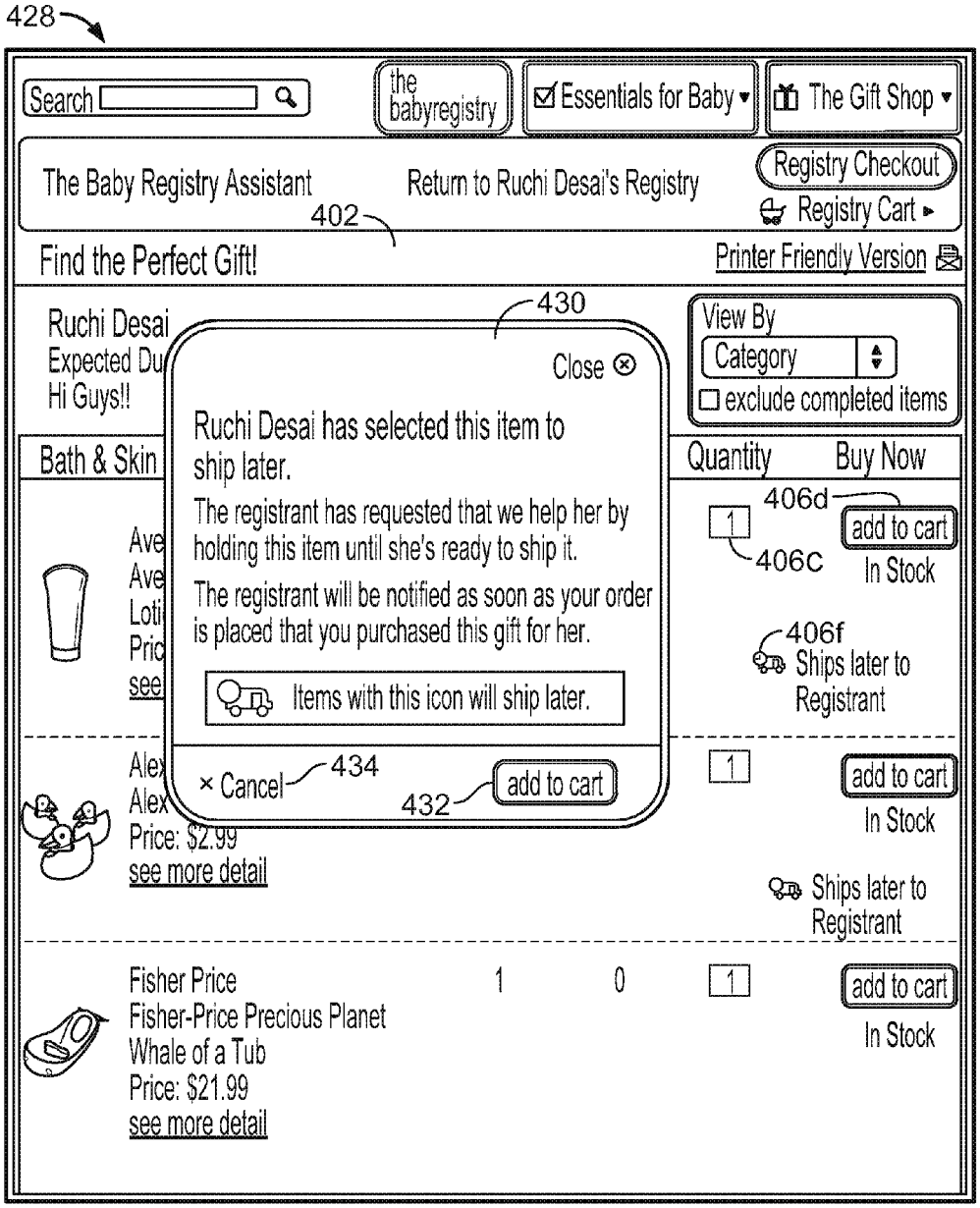
FIG. 4D is a screen-shot illustrating an example of a purchaser web page for a gift registry that includes a ship later to registrant pop-up window.

FIG. 4D is a screen-shot 428 illustrating the example of a purchaser web page 402 for a gift registry that includes a ship later to registrant pop-up window 430. Continuing with the example of FIGS. 4A-C, the client 110 can display the web page 402 to the purchaser on display device 110*a* using information it receives from the server 102. The purchaser can activate the add to cart button 406*d* to add the item 406 in the quantity entered in the quantity input field 406*c* to the purchaser's online shopping cart. Icon 406*f* indicates that the registrant has designated the item as ship later to registrant. When the purchaser activates the add to cart button 406*d* for the item 406, the pop-up window 430 is displayed over web page 402 on display device 110*a*. The pop-up window 430 includes information explaining to the purchaser the meaning of the "ship later to registrant" option.

The purchaser can then decide to activate an add to cart button 432 to add the item 406 to the purchaser's online shopping cart. Additionally, the quantity purchased by the purchaser of the item 406 will be added to the total number of the item 406 purchased for the registrant. Alternatively, the purchaser can activate a cancel option 434 to cancel the purchase of item 406 and return to the web page 402. For example, the purchaser may want the registrant to receive the purchaser's gift as soon as possible, so the purchaser may cancel the selection of item 406 and select another item for purchase that is not designated as ship later to registrant.

Figure 4E:
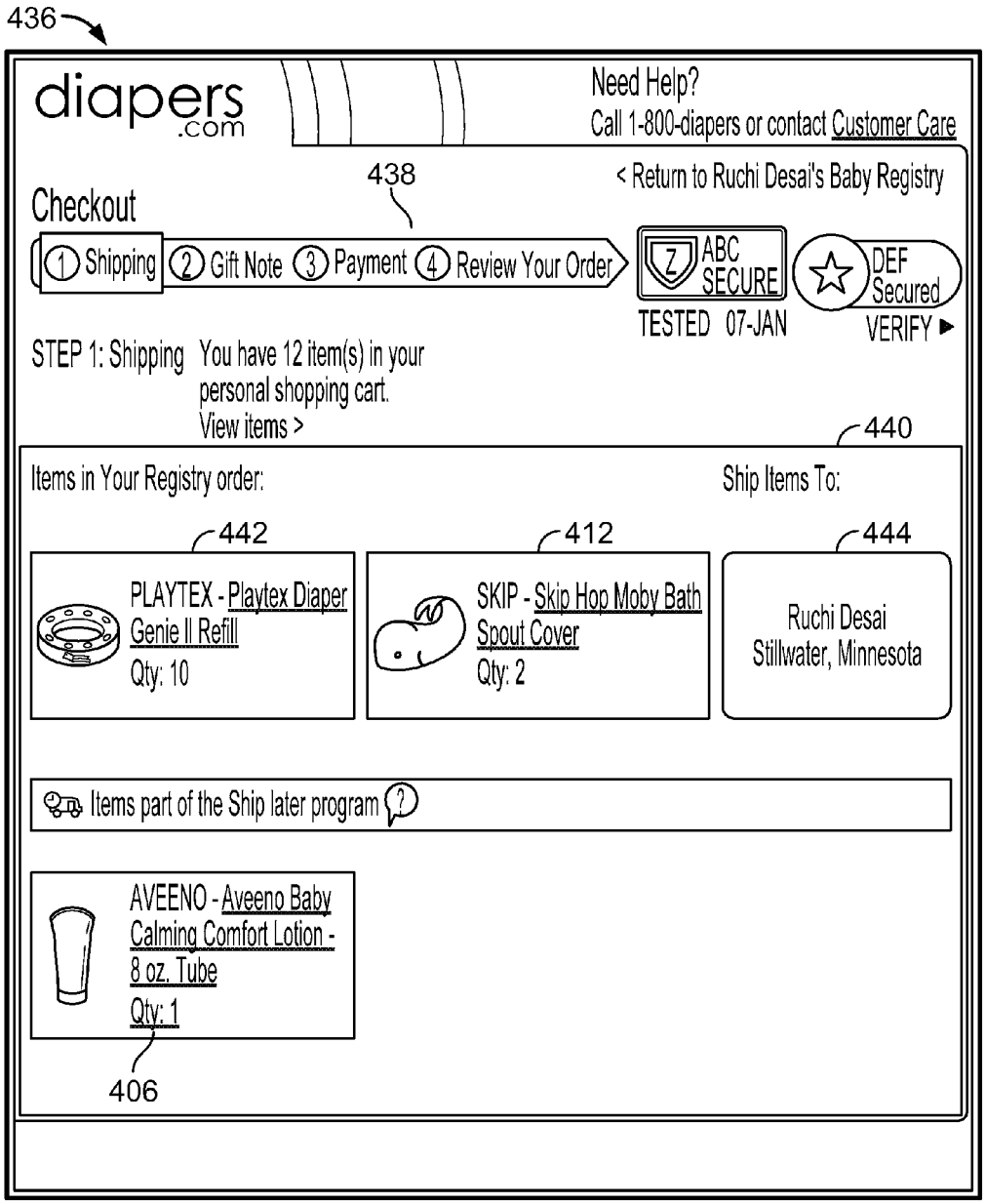
FIG. 4E is a screen-shot illustrating an example of a shipping web page for an online checkout.

FIG. 4E is a screen-shot 436 illustrating an example of a shipping web page 438 for an online checkout. Continuing the example of FIGS. 4A-4D, the purchaser selected items 406 and 412 for purchase. Therefore, client 110 displays web page 438 to the purchaser on display device 110*a* using information it receives from the server 102 (e.g., the name and location of the registrant for indicator 444 can be retrieved from database 104*b*). The web page 438 shows items in the purchaser's registry order 440 for the registrant. In addition, the web page 438 identifies the ordered items that are available for immediate shipment to the registrant (e.g., item 412 and item 442) and the ordered items that are part of the ship later program (e.g., item 406).

Figure 4F:
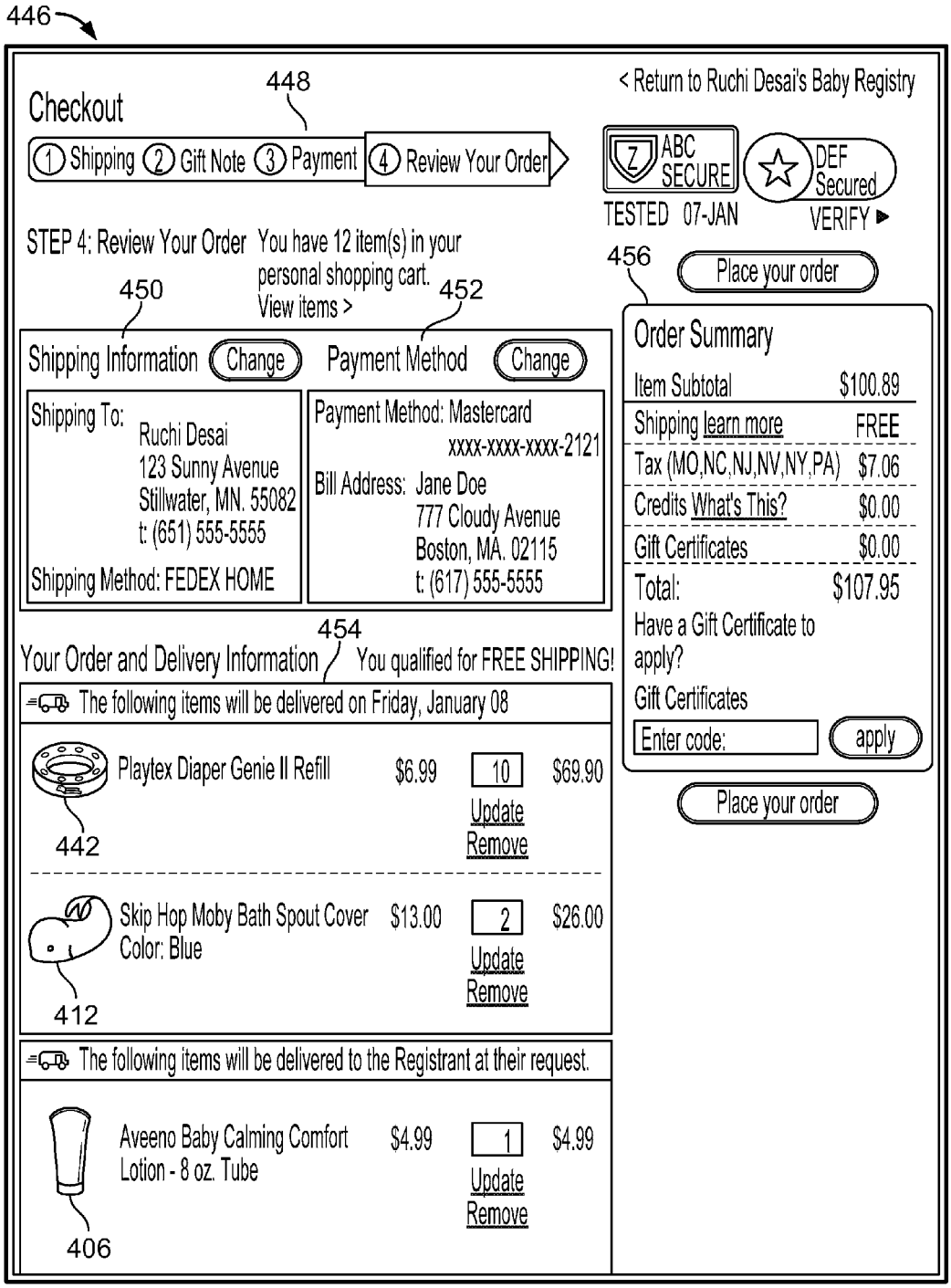
FIG. 4F is a screen-shot illustrating an example of an order review web page for an online checkout.

FIG. 4F is a screen-shot 446 illustrating an example of an order review web page 448 for an online checkout. Continuing with the example of FIGS. 4A-4E, the client 110 can display the web page 448 to the purchaser on display device 110*a* using information it receives from the server 102 (e.g., shipping information 450 can be retrieved from database 104*b*). For example, the purchaser can enter the information for payment method 452 on a previous payment web page. Order and delivery information 454 shows item 412 and item 442 available for immediate delivery while item 406 will be delivered to the registrant at their request as it is part of the ship later program. Additionally, the web page 448 includes an order summary section 456 that shows the various costs associated with the registry order to the purchaser.

Figure 4G:
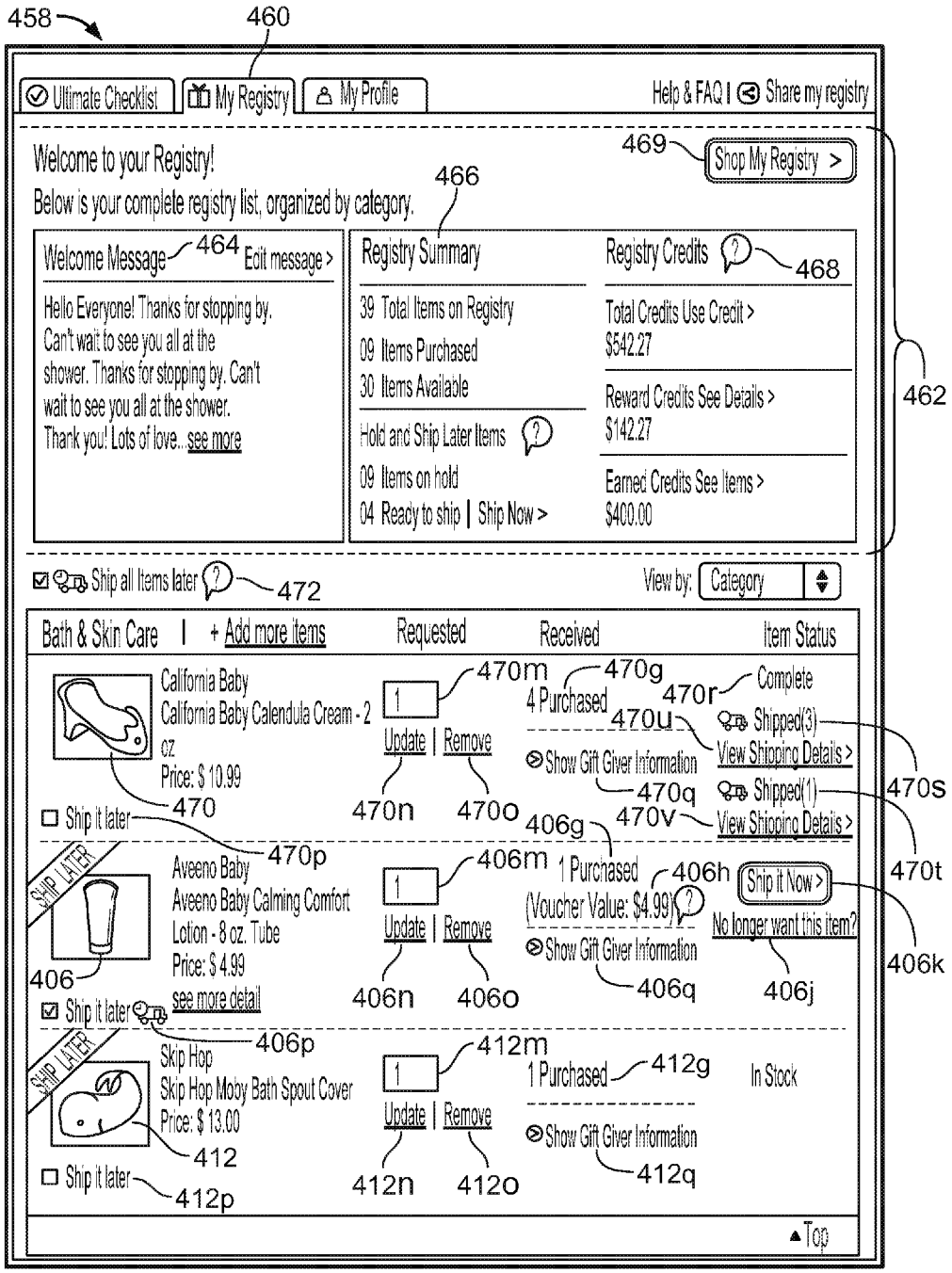
FIG. 4G is a screen-shot illustrating an example of a registry web page showing the received status of the registry items.

FIG. 4G is a screen-shot 458 illustrating an example of a registry web page 460 showing the purchase status of registry items. Referring to FIG. 1, in some implementations, a registrant can run a web browser on client 108 and connect to the web server 102 by way of the network 106. The registrant can access the registrant's gift registry for an online retail web site using the web browser. For example, the client 108 can display web pages that include a GUI on display device 108*a* that allow the registrant to login to the registrant's gift registry where the server 102 can verify the registrant's credentials using information stored in database 104*b*. The client 108 can display web page 460 to the registrant on display device 108*a*, enabling the registrant to review the status of the registrant's gift registry shown on the web page 460. The information regarding the status of the gift registry for the registrant can be retrieved by the server 102 from databases 104*a*, 104*b*, 104*c*.

Web page 460 includes a registry dashboard 462 that includes an input field 464, a registry summary 466 and registry credits 468. The registry dashboard 462 is equivalent to the registry dashboard 226 described with reference to FIG. 2. Web page 460 can be an updated version of the web page 202 as described with reference to FIG. 2. Furthermore, the functionality of shipping hold all option 472, shipping hold options 470*p*, 406*p*, 412*p*, request item number input fields 470*m*, 406*m*, 412*m*, update controls 470*n*, 406*n*, 412*n*, remove controls 470*o*, 406*o*, 412*o* are previously described with reference to equivalent options, fields and controls in FIG. 2.

The web page 460 shows the number of items purchased and received for each item in the registry via number of items purchased indicators 470*g*, 406*g*, 412*g* for items 470, 406, 412, respectively. The number of items purchased indicators 470*g*, 406*g*, 412*g* indicate registry items bought for the registrant, for example, by gift givers. Additionally, for item 406, which the registrant has designated as a ship it later item, a voucher value 406*h* indicates the price at which a voucher for item 406 was purchased (i.e., the price of the item at the time the voucher was purchased) for the registrant by a gift giver. Additionally, the registrant can convert the value of the voucher (voucher value 406*h*) to a registry credit. The registrant can apply registry credits towards the purchase of other items from the online retail web site. Web page 460 further provides a "Ship it Now" button 406*k*, which enables the registrant to instruct the online retail web site to apply the purchased voucher for the item towards the purchase of the item (i.e., redeem the voucher for the item) and to subsequently ship the item 406. In contrast, web page 460 also provides a "No Longer Want this Item" control 406*j*, which enables the registrant to instruct the online retail web site to add the voucher value for item 406 to the registrant's registry credits. A more detailed description of this redemption process is described below in connection with FIGS. 5A-5F.

The registrant can activate show gift giver information controls 470*q*, 406*q*, 412*q* to request that the web page 460 show information about the one or more gift givers for items 470, 406, 412, respectively. For example, the gift giver information can include the gift giver's name and address.

In connection with item 470, web page 460 displays item status indicators 470*r*, 470*s*, 470*t*. Item status indicator 470*r* indicates the purchases for the item 470 are complete (i.e., the desired quantities of item 470 have been ordered, shipped and delivered to the registrant). Item status indicator 470*s* indicates three of the four of item 470 ordered were shipped in one shipment and item status indicator 470*t* indicates the last item 470 ordered was shipped in another shipment. The registrant can activate view shipping details controls 470*u*, 470*v* to view the shipping details for the shipments associated with item status indicators 470*s*, 470*t*, respectively.

In some implementations, a registrant can activate a shop my registry button 469. The registrant can purchase items from the registrant's own gift registry using, for example, registry credits 468 to pay for the ordered items. For example, referring to FIG. 1, the client 108 can display on display device 108*a* a web page similar to web page 402 in FIG. 4A to allow the registrant to select and purchase items from the registrant's gift registry. Additionally, the registrant can shop for additional items on the online retailer's web site not included in the registrant's gift registry. At checkout, registry credits can be applied automatically to purchase all items included in the registrant's online shopping cart. If the registry credits do not cover the total amount due at checkout, regular ecommerce methods can be used to pay for the remaining balance.

In some implementations, the electronic registry may generate an electronic registry status web page for a registrant that summarizes the items and the quantities of such items for which the registrant has registered and that reflects the quantities of each item for which the registrant has registered that have been purchased for the registrant already. In some cases, the quantities of each item for which the registrant has registered that have been purchased for the registrant may be reflected by an indication of the quantity of the items for which the registrant has registered that the registrant still needs. For example, if the registrant registered for ten cases of diapers and six cases of diapers have been purchased for the registrant from the registrant's registry, the web page may reflect that the registrant still needs four cases of diapers. For registry items for which the registrant has selected the "ship later" option, the electronic registry may track the quantity of vouchers purchased for each "ship later" item and update the indications of the quantity of each "ship later" item that the registrant still needs based on the quantity of the vouchers purchased for the various "ship later" items. Continuing with the above example, if the registrant registered for ten cases of diapers while also designating the diapers as a "ship later" registry item and six vouchers for a case of diapers have been purchased for the registrant off of the registrant's registry, the web page may reflect that the registrant still needs four cases of diapers even if the registrant has not yet redeemed any of the six vouchers that already have been purchased for a case diapers.

Figure 5A:
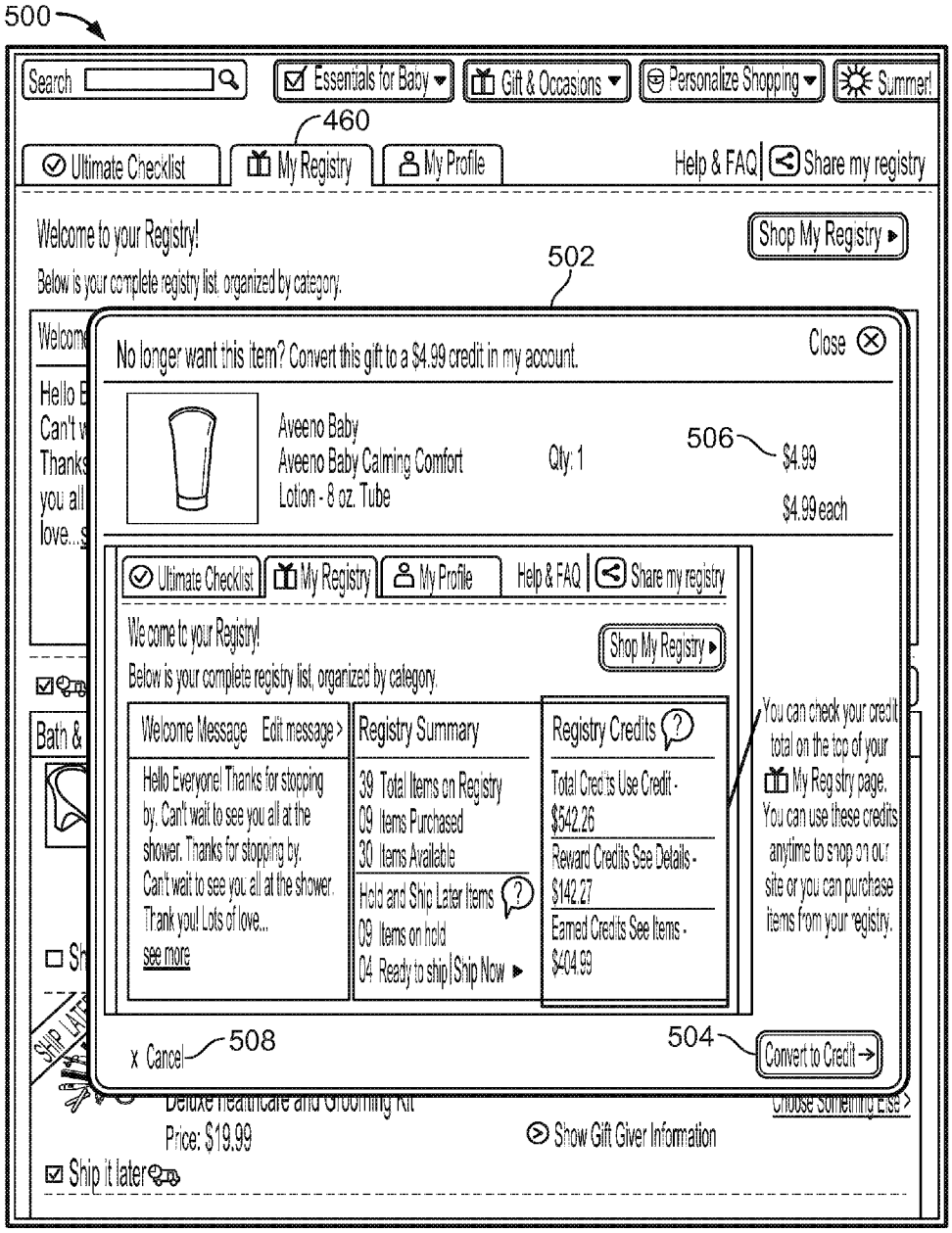
FIG. 5A is a screen-shot illustrating an example of a registry web page that includes a convert gift to voucher value pop-up window.

FIG. 5A is a screen-shot 500 illustrating the example of a registry web page 460 that includes a convert gift to voucher value pop-up window 502. Continuing with the example from FIG. 4G, the client 108 can display the web page 460 to the registrant on display device 108*a* using information it receives from the server 102. The registrant can activate the "No Longer Want this Item" control 406*j* resulting in the display of pop-up window 502 on web page 460. For example, the registrant can activate the control 406*j* if the registrant does not want the online retailer to ship the ordered item 406 to the registrant. In such a scenario, the pop-up window 502 enables the registrant to convert the voucher for the ordered item 406 to its equivalent voucher value 406*h*, which the online retail web site then adds as a credit to the registrant's account. Specifically, pop-up window 502 provides "Convert to Credit" button 504, which the registrant can activate to cause the online retail web site to convert the voucher for the item (whose value is voucher value 506) to a registry credit. In response to such activation of the "Convert to Credit" button, the server 102 will update the registrant information included in databases 104*b*, 104*c*. Alternatively, the registrant can activate the cancel control 508 to cancel the conversion of the gift to its voucher value. In some cases, the voucher value for a voucher for an item purchased for a registrant, where the registrant designated the item to be shipped later, may be greater than the price for which the item currently is selling. For example, after the voucher for the item has been purchased for the registrant, the online retail web site may reduce the price of the item as part of a promotional sale event. In such scenarios, the online retailer still enables the registrant to convert the voucher to a registry credit, where the registry is credited with the original voucher value. In contrast, in some cases, the voucher value for a voucher for an item purchased for a registrant, where the registrant designated the item to be shipped later, may be less than the price for which the item currently is selling. For example, after the voucher for the item has been purchased for the registrant, the online retail web site may increase the price of the item. In such scenarios, the online retail web site enables the registrant to convert the voucher to a registry credit, where the registry is credited with the original voucher value for the amount paid by the gift giver at the time of purchase. However, if the registrant decides against exchanging the purchased voucher for a registry credit, and instead decides to redeem the voucher for the item and instructs the online retail web site to ship the item to the registrant, the online retail web site will ship the item to the registrant without requiring the registrant to pay the difference between the voucher value for the item and the price for which the item is currently being sold.

Figure 5B:
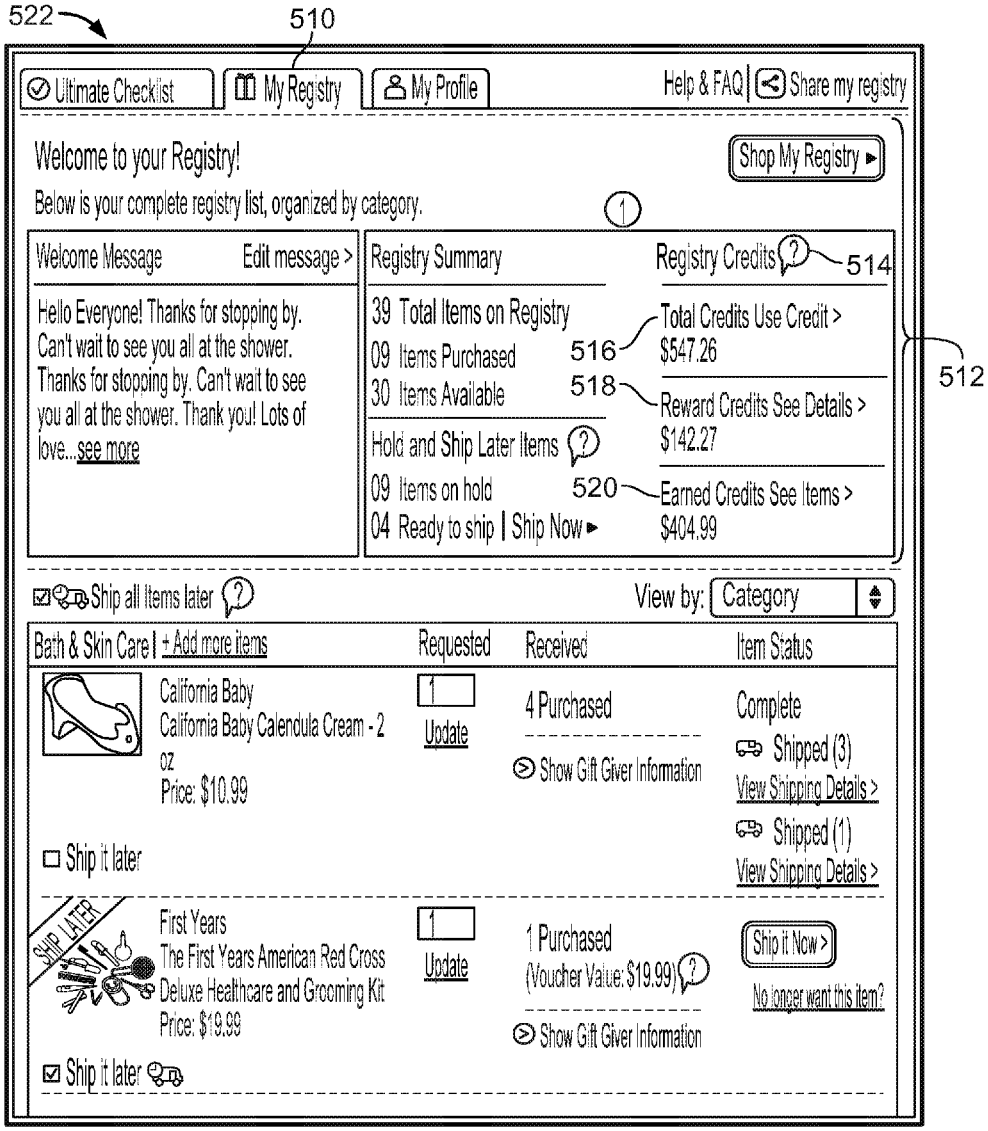
FIG. 5B is a screen-shot illustrating an example of a registry web page where registry credits are updated to reflect the conversion of a ship later item to its voucher value.

FIG. 5B is a screen-shot 522 illustrating an example of a registry web page 510 where registry credits 514 included in a registry dashboard 512 are updated (to reflect the conversion of a voucher for a ship later item to its voucher value. Continuing with the example from FIG. 5A, the client 108 can display the web page 510 to the registrant on display device 108*a* using information it receives from the server 102. Specifically, the server 102 can retrieve information from databases 104*b*, 104*c* to determine the dollar amount of the total registry credits 516, reward credits 518 and earned credits 520, for display in the registry dashboard 512. As shown in FIG. 5B, the online retail web site has increased earned credits 520 by the voucher amount for the credited voucher for the item (i.e., voucher value 406*h* for item 406). This results in an increase to the total registry credits 516.

Figure 5C:
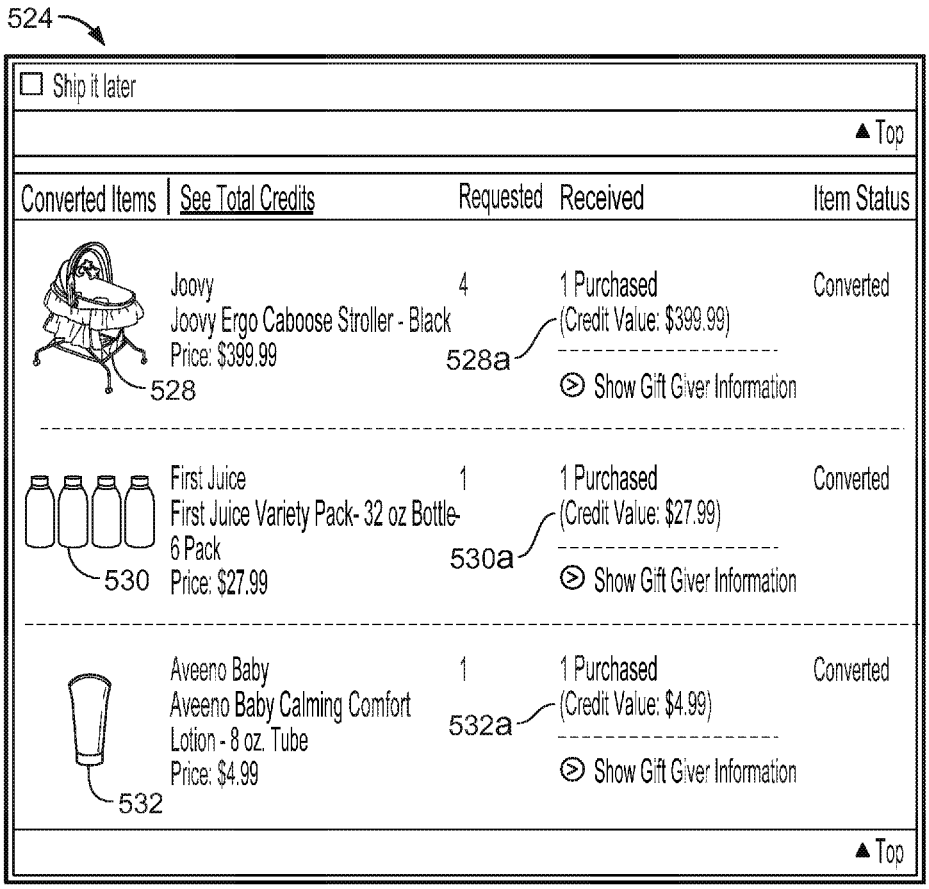
FIG. 5C is a screen-shot illustrating an example of a registry web page showing items that have been converted to their voucher values.

FIG. 5C is a screen-shot 524 illustrating an example of a registry web page 526 showing items 528, 530, 532. In the example of FIG. 5C, vouchers purchased for the items 528, 530, 532 that were designated as ship later items by the registrant are converted to their voucher values and credited to the registrant's registry account. In addition, web page 526 shows the actual amounts (credit values 528*a*, 530*a*, 532*a*) credited to the registrant's account for each item 528, 530, 532, respectively, by the online retail web site. The items 528, 530, 532 are considered "dead" and cannot be reactivated for purchase and added to the gift registry by the registrant from the converted items registry web page 526. The history of purchases and credits remains in the gift registry only for viewing by the registrant. If, for example, a registrant changes the registrant's mind and would like to add an item to the registry where the registrant previously converted a purchased voucher for the item to its voucher value and credited the registry account with the voucher value (e.g., an item included on registry web page 526 considered a "dead" item), the registrant can browse the online retail web site to view the web page for the item. As described in FIG. 3B, the registrant can then again add the item to their registry.

Referring to FIG. 1, in some implementations, a registrant can run a web browser on client 108 and connect to the web server 102 by way of the network 106. The registrant can access an online retail web site using the web browser. The registrant can then access the registrant's gift registry with the online retail web site. For example, the registrant can access a web page included in the online retail web site that enables the registrant to log into their gift registry using credentials established during set up of the registry (as described in FIG. 3A). The server 102 receives the credentials and verifies the credentials by comparing them to the credentials stored for the registrant in the database 104*b*. Upon verification, the server 102 grants the registrant access to the registrant's gift registry and, for example, causes client 108 to display web page 526 on display device 108*a*. The server can retrieve information from databases 104*a*, 104*b*, 104*c* to display web page 526.

Figure 5D:
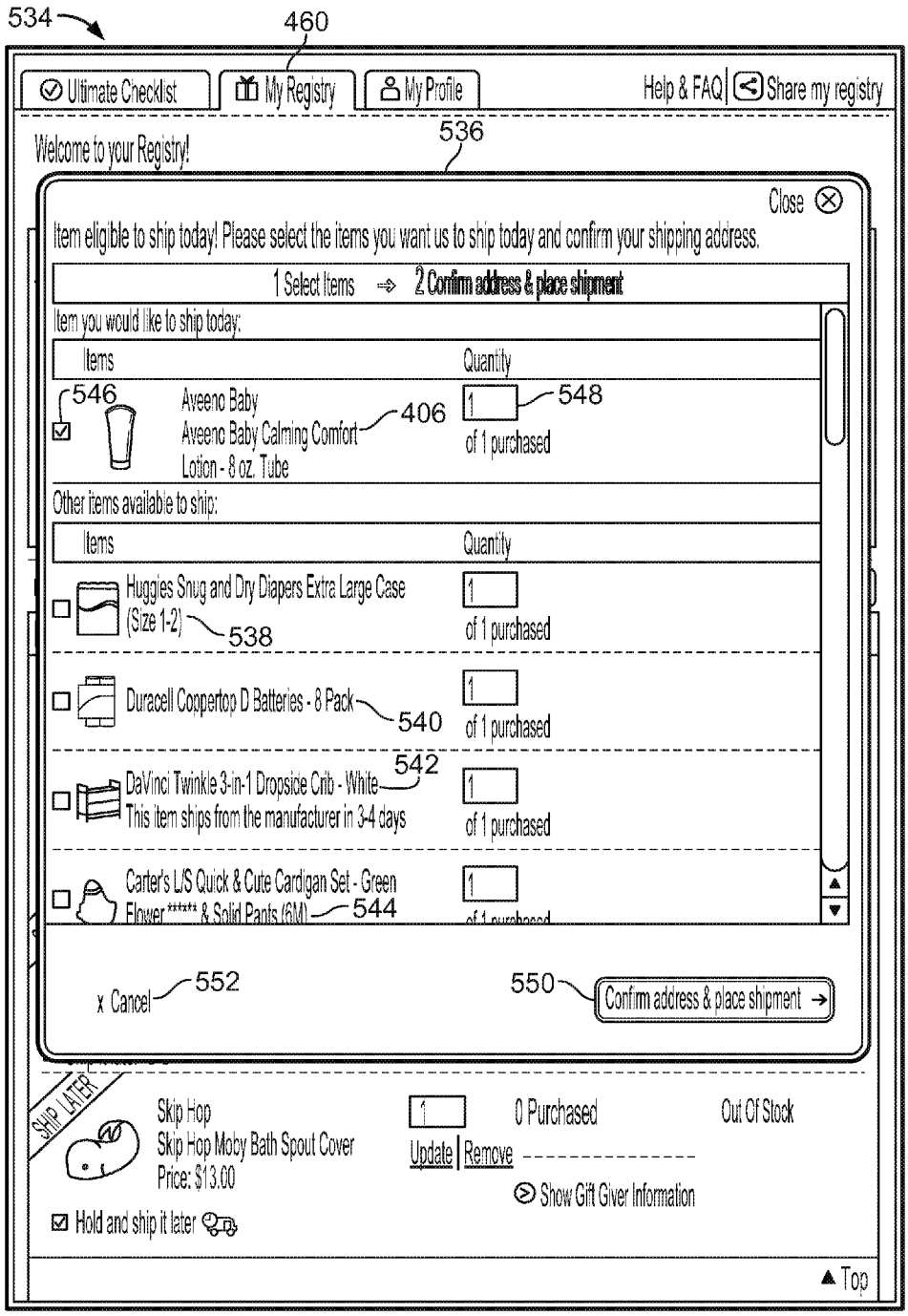
FIG. 5D is a screen-shot illustrating an example of a registry web page that includes a ship now pop-up window.

FIG. 5D is a screen-shot 534 illustrating the example of a registry web page 460 that includes a ship now pop-up window 536. Continuing with the example from FIG. 4G, the registrant can review the status of the registrant's gift registry shown on the web page 460. The information regarding the status of the gift registry for the registrant can be retrieved by the server 102 from databases 104*a*, 104*b*, 104*c*. The registrant can activate the "Ship it Now" button 406*k* to arrange for the redemption of a voucher for the item and for shipment of the item where a voucher for the item has been purchased for the registrant and where the registrant previously designated the item as part of the ship later program (e.g., item 406). In response to activation of the "Ship it Now" button 406*k*, web page 460 displays pop-up window 536 on the web page 460. The pop-up window 536 shows item 406 along with items 538, 540, 542, 544. Items 538, 540, 542, 544 are additional items included in the ship later program where vouchers have been purchased for the items by gift givers and where the items are available for shipping to the registrant as the items are in stock and the registrant has not yet selected any of these items for shipping. As illustrated in FIG. 5D, the registrant has selected item 406 for redemption and shipment by activating check box 546. In the event that more than one voucher for any particular item included in the ship later program has been purchased for the registrant, the registrant can enter the quantity of vouchers for that item that are to be redeemed and shipped now in quantity input field 548. In such cases, the quantity of the vouchers for the item to be redeemed cannot exceed the quantity of the vouchers for the item that gift givers have purchased for the registrant. The registrant can activate a confirm address and place shipment button 550 to continue with the shipment of the item 406. Alternatively, the registrant can activate a cancel control 552 to cancel shipment of item 406 and return to web page 460.

In some implementations, a gift giver may have purchased a voucher for item 406 for less than the current retail price for the item at checkout. Nevertheless, the registrant still can redeem the voucher for item 406. In this case, the online retailer still ships the purchased item 406 to the gift giver despite the price difference between the purchase price of voucher for the item 406 and the current price at which item 406 is being sold.

In some implementations, a gift giver may have purchased a voucher for item 406 for more than the current retail price of the item at checkout. The registrant still can redeem the voucher for the item 406. In this case, the online retailer grants the registrant a credit for the price difference between the purchase price of the voucher and the current retail price of the item. For example, referring to FIG. 1, the server 102 can determine the price difference using data available in databases 104*a* and 104*c*. The server 102 can apply the refund for the price difference to the registrant's account information included in database 104*b*.

As further illustrated in FIG. 5D, pop-up window 536 also enables the registrant to select one or more of additional items 538, 540, 542, 544 for redemption and shipment in the same order as item 406.

Figure 5E:
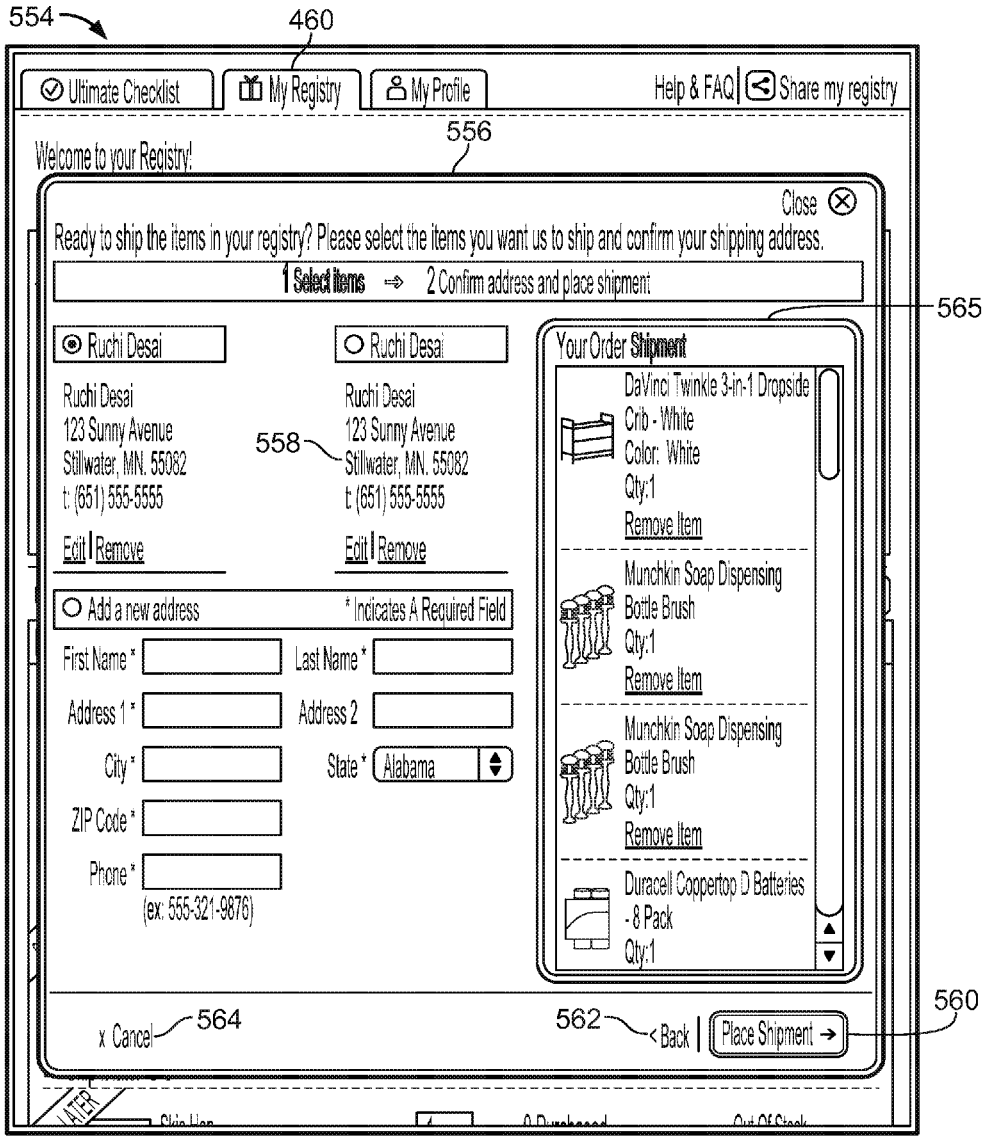
FIG. 5E is a screen-shot illustrating an example of a registry web page that includes a shipping information pop-up window.

FIG. 5E is a screen-shot 554 illustrating the example of a registry web page 460 that includes a shipping information pop-up window 556. Continuing with the example from FIG. 5D, in response to the registrant activating the confirm address and place shipment button 550 of pop-up window 536, the online retail web site causes display of pop-up window 556 on web page 460. Pop-up window 556 includes shipping information 558 and a view of items included in the order for shipment (order view 565). In addition, pop-up window 556 provides a "Place Shipment Button" 560, which the registrant can activate to instruct the online retail web site to initiate the shipping of the items included in the order view 565. The registrant also can activate a back control 562 to return to pop-up window 536 or a cancel control 564 to cancel the order and return to web page 460.

Figure 5F:
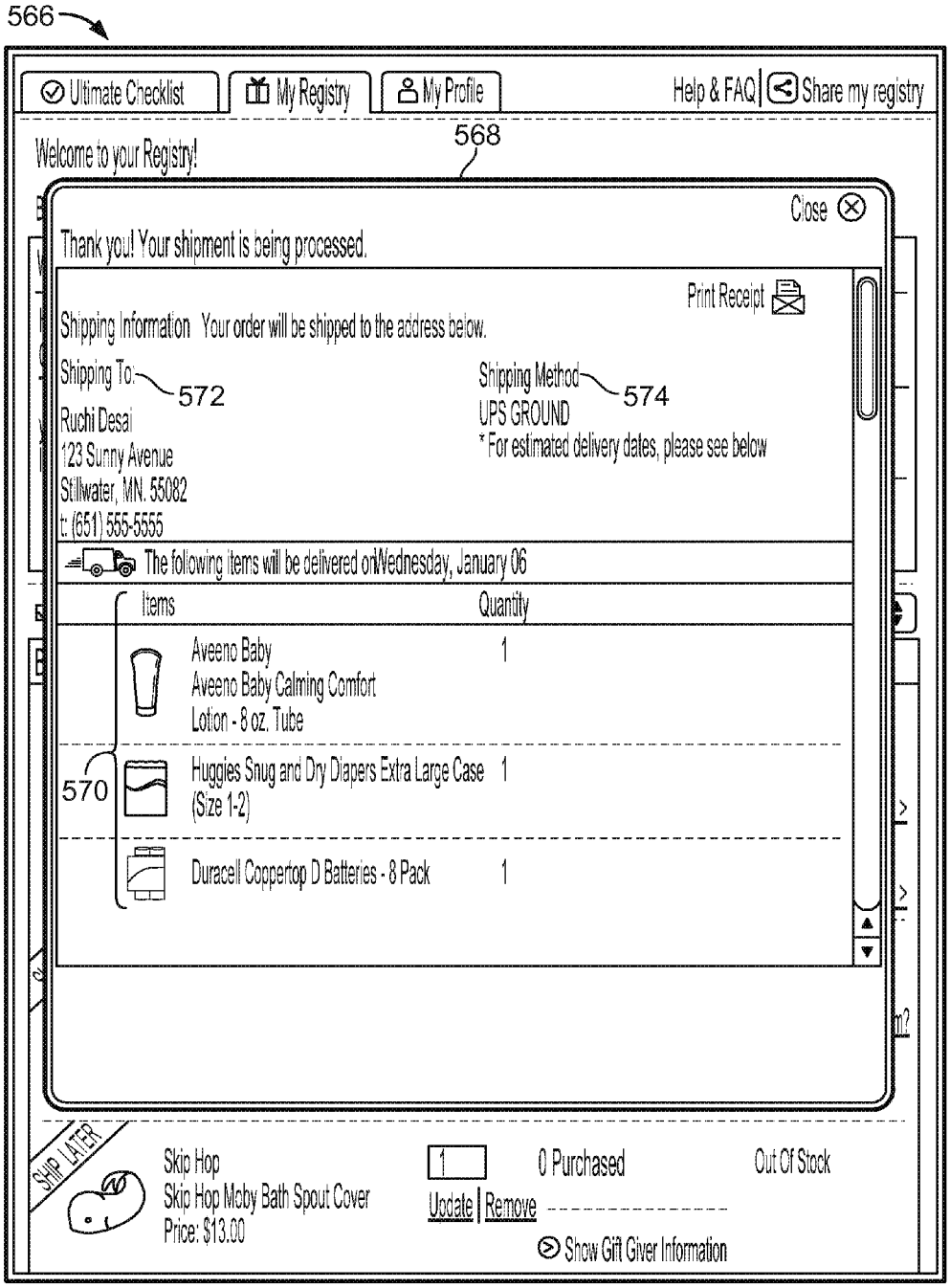
FIG. 5F is a screen-shot illustrating an example of a registry web page that includes a shipment confirmation pop-up window.

FIG. 5F is a screen-shot 566 illustrating the example of a registry web page 460 that includes a shipment confirmation pop-up window 568. Continuing with the example from FIG. 5E, in response to the registrant activating the "Place Shipment" button 560 of pop-up window 556, the online retail web site causes the display of pop-up window 568 on web page 460. The pop-up window 568 shows items shipped 570, a ship to address 572 and a shipping method 574.

In some implementations, if the online retail web site is going to discontinue an item that a registrant has designated for inclusion in the ship later program (and a gift giver has purchased a voucher for the item for the registrant, the online retail web site may notify the registrant in advance of discontinuing the item and invite the registrant either to redeem the voucher for the item in order to have the item shipped to the registrant before it is discontinued, or to convert the voucher value for the item to a registry credit. Additionally or alternatively, if a voucher for a ship later program item has been purchased and the item eventually goes out of stock, the online retail web site may notify the registrant that the item is out of stock and invite the registrant to convert the voucher value of the item to a registry credit. In either case, the online retail web site may notify the registrant by way of an email message. For example, referring to FIG. 1, the server 102 can access database 104*b* to retrieve account information for the registrant that includes the registrant's email address. Additionally, by accessing databases 104*a*, 104*b*, 104*c*, server 102 can determine the status of a ship later program item where a voucher for the item has been purchased and not yet redeemed. Knowing the current status of the item, the server 102 can then determine if any conditions are met that require a notification be sent to the registrant.

Figure 6:
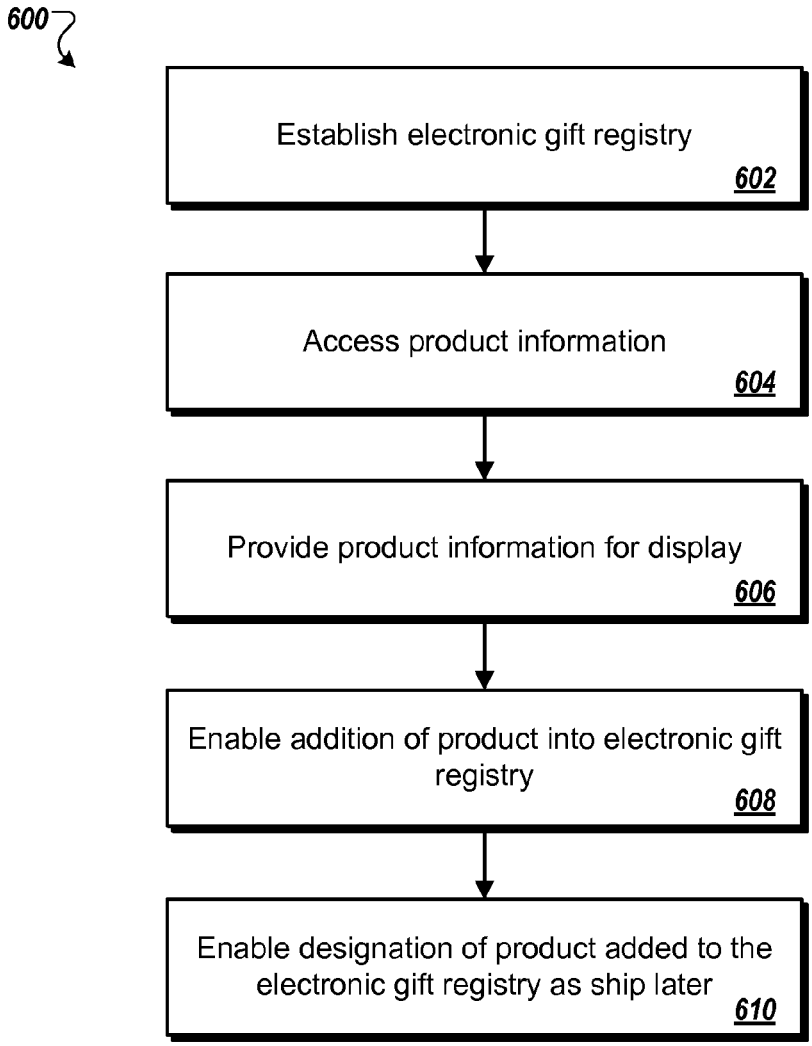
FIG. 6 is an illustrative flow chart showing example operations for an electronic gift registry.

FIG. 6 is an illustrative flow chart showing example operations 600 for an electronic gift registry. For example, the network architecture 100 in FIG. 1 can perform the operations 600. The operations 600 are described with reference to FIGS. 1, 2 and 3A-3D.

The operations 600 begin by establishing an electronic gift registry for a consumer in step 602. For example, a server (e.g., server 102) can host an on-line retail web site. A customer can create an on-line account with the on-line retailer and establish a gift registry. Product information is accessed for the registrant in operation 604. For example, the customer (a registrant with an established gift registry with the on-line retailer) can browse the on-line retailer's web site and request product web pages for specific products the registrant may want to add to the registrant's gift registry. Product information is provided for display on the registrant's display device in operation 606. For example, a registrant, using client 108, can run a web browser and view web pages on display device 108*a*. The server 102 can provide a web page that includes the product information for the on-line retailer for the registrant to view on display device 108*a*. Addition of one or more of the products displayed to the registrant's electronic gift registry is enabled in operation 608. For example, the GUI of the product web page can provide buttons, controls and input fields that the registrant can activate to add one or more of the products displayed on the web page to the registrant's electronic gift registry. Designation of the product added to the electronic gift registry as ship later is enabled in operation 610. For example, the GUI of the web page for the electronic gift registry includes a shipping hold option associated with the product that the registrant can activate to designate the product as ship later.

Figure 7:
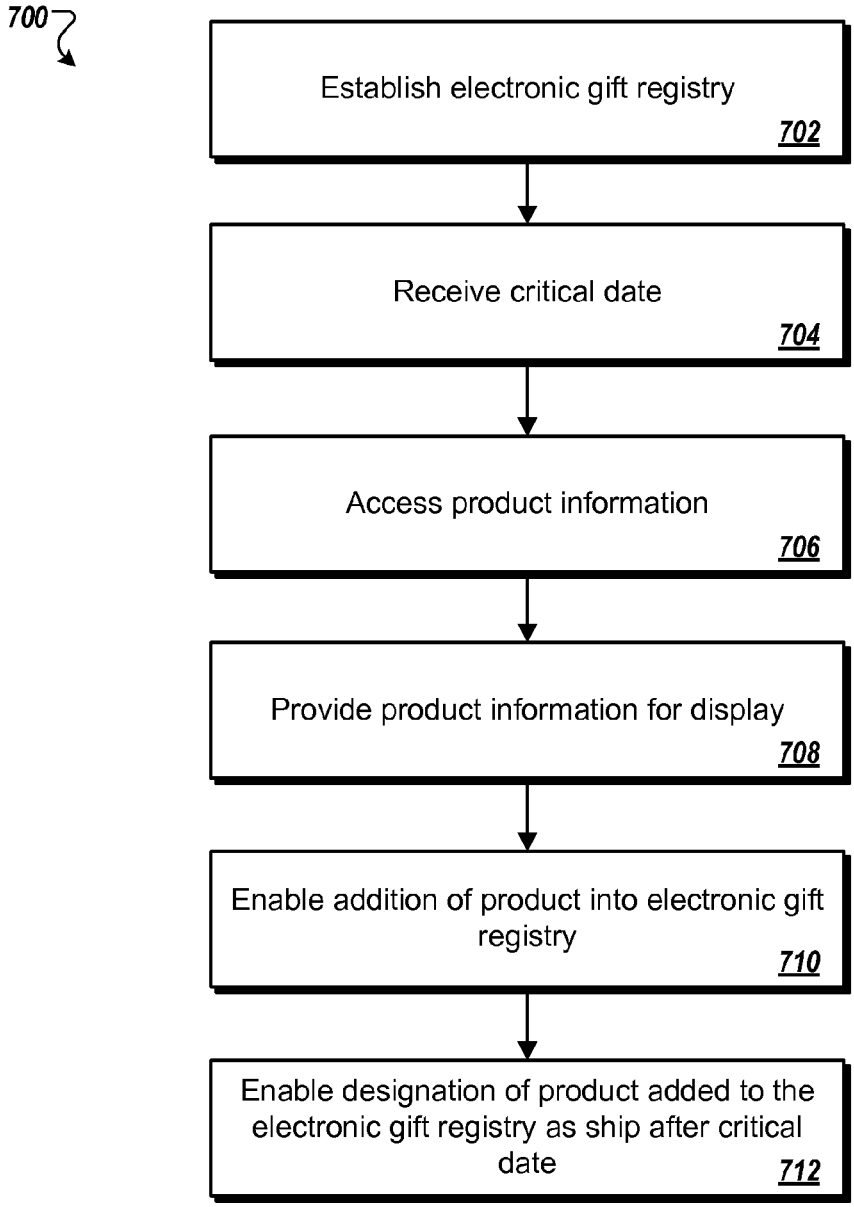
FIG. 7 is an illustrative flow chart showing alternative example operations for an electronic gift registry.

FIG. 7 is an illustrative flow chart showing alternative example operations 700 for an electronic gift registry. For example, the network architecture 100 in FIG. 1 can perform the operations 700. The operations 700 are described with reference to FIGS. 2 and 3A-3D.

The operations 700 begin by establishing an electronic gift registry for a consumer in operation 702. For example, a server (e.g., server 102) can host an on-line retail web site. A customer can create an on-line account with the on-line retailer and establish a gift registry. A critical date is received in operation 704. For example, the customer (a registrant with an established gift registry with the on-line retailer), using client 108, can run a web browser and view web pages on display device 108*a*. The server 102 can provide a web page for the on-line retailer that includes a GUI for the registrant's gift registry that the registrant can view on display device 108*a*. The GUI can include an input field that allows the registrant to enter a critical date. The on-line retailer can ship any product or item designated for the ship later program by the registrant after the critical date. Product information is accessed for the registrant in operation 706. For example, the registrant can browse the on-line retailer's web site and request product web pages for specific products or items the registrant may want to add to the registrant's gift registry. Product information is provided for display on the registrant's display device in operation 708. For example, a registrant, using client 108, can run a web browser and view web pages on display device 108*a*. The server 102 can provide a web page that includes the product information for the on-line retailer for the registrant to view on display device 108*a*. Addition of one or more of the products displayed to the registrant's electronic gift registry is enabled in operation 710. For example, the GUI of the product web page can provide buttons, controls and input fields that the registrant can activate to add one or more of the products displayed on the web page to the registrant's electronic gift registry. Designation of the product added to the electronic gift registry as ship after critical date is enabled in operation 712. For example, the GUI of the web page for the electronic gift registry includes a shipping hold option associated with the product that the registrant can activate to designate the product as ship after critical date.

Figure 8:
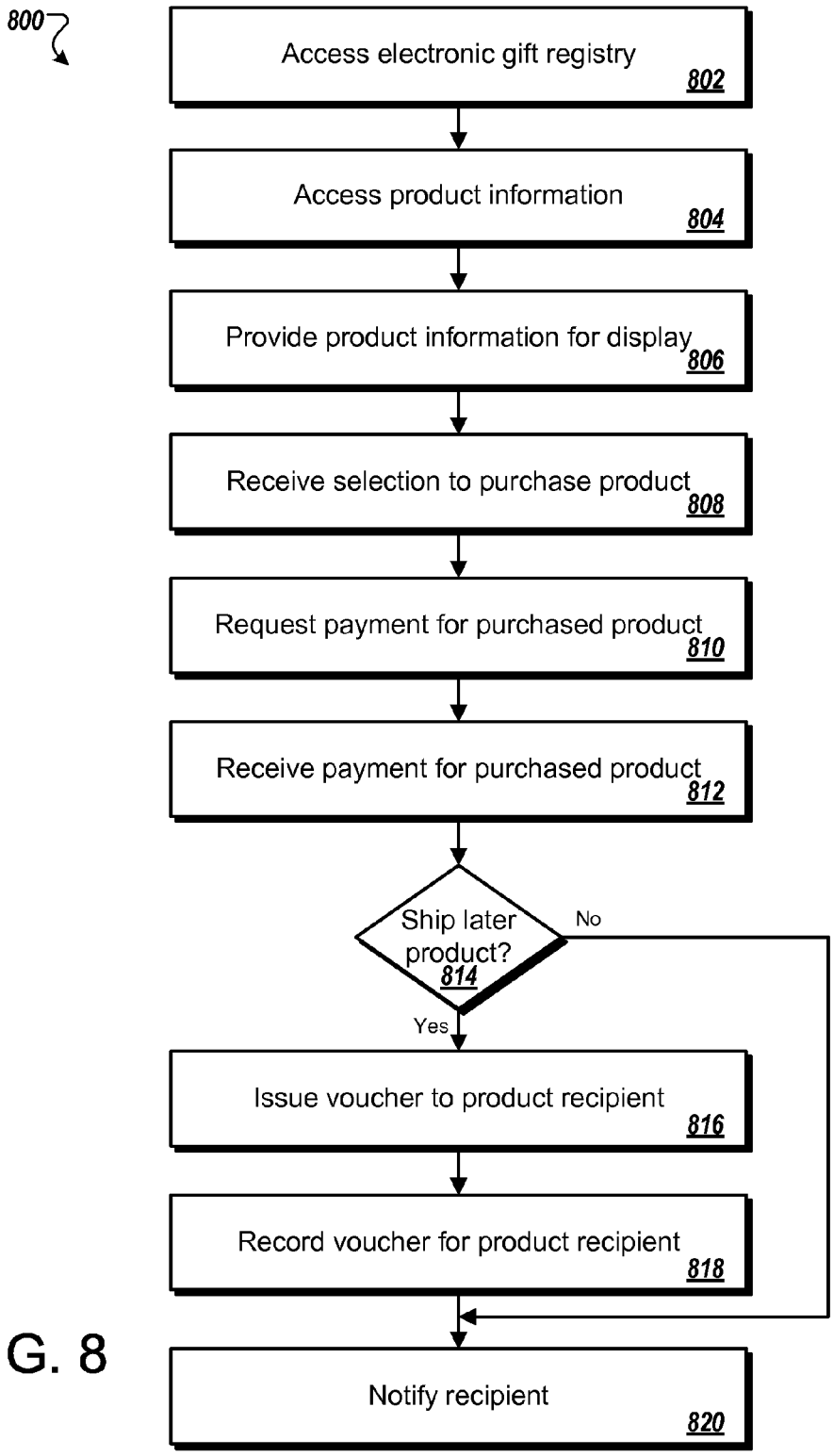
FIG. 8 is an illustrative flow chart showing example operations for processing the purchase of an item included in an electronic gift registry.

FIG. 8 is an illustrative flow chart showing example operations 800 for processing the purchase of an item included in an electronic gift registry. For example, the network architecture 100 in FIG. 1 can perform the operations 800. The operations 800 are described with reference to FIGS. 4A-4G.

The operations 800 begin by accessing an electronic gift registry in step 802. For example, a purchaser or gift giver can access the gift registry of a friend or family member (a recipient). Product information is accessed for the purchaser in operation 804. For example, a purchaser can access the electronic gift registry of a registrant who will be the recipient of a gift from the purchaser selected from the gift registry. The purchaser can request product web pages for specific products the purchaser may want to purchase from the registrant's gift registry. Product information is provided for display on the purchaser's display device in operation 806. For example, a purchaser, using client 110, can run a web browser and view web pages on display device 110*a*. The server 102 can provide a web page that includes the product information for the on-line retailer for the purchaser to view on display device 108*a*. Selection to purchase the product is received in operation 808. For example, the web page that includes the product information can include a control or button that the purchaser can activate to select the product for purchase. The purchased product is added to an on-line shopping cart for the purchaser. Payment for the purchased product is requested in operation 810. For example, the purchaser can check out and purchase the contents of the purchaser's on-line shopping cart. At check out the on-line retailer can request payment for the products included in the on-line shopping cart. Payment for the purchased product is received in operation 812. For example, the purchaser at check out can provide payment information (e.g., a credit card number) to the on-line retailer. Ecommerce methods can be used to pay for the products in the purchaser's shopping cart. In operation 814, if the purchased product is part of the ship later program, a voucher for the product is issued to the recipient of the product. For example, the on-line retailer issues a voucher reflective of the purchase price of the product to the recipient (registrant). The voucher is recorded for the recipient of the product in step 818. For example, the on-line retailer records the receipt of the voucher with the associated product entry in the registrant's gift registry. The recipient is notified of the product purchase in operation 820. For example, the recipient can receive an email from the on-line retailer informing the recipient of the gift purchase. If the purchased product is not part of the ship later program, the operations will continue to operation 820 and the recipient is notified of the product purchase.

Figure 9:
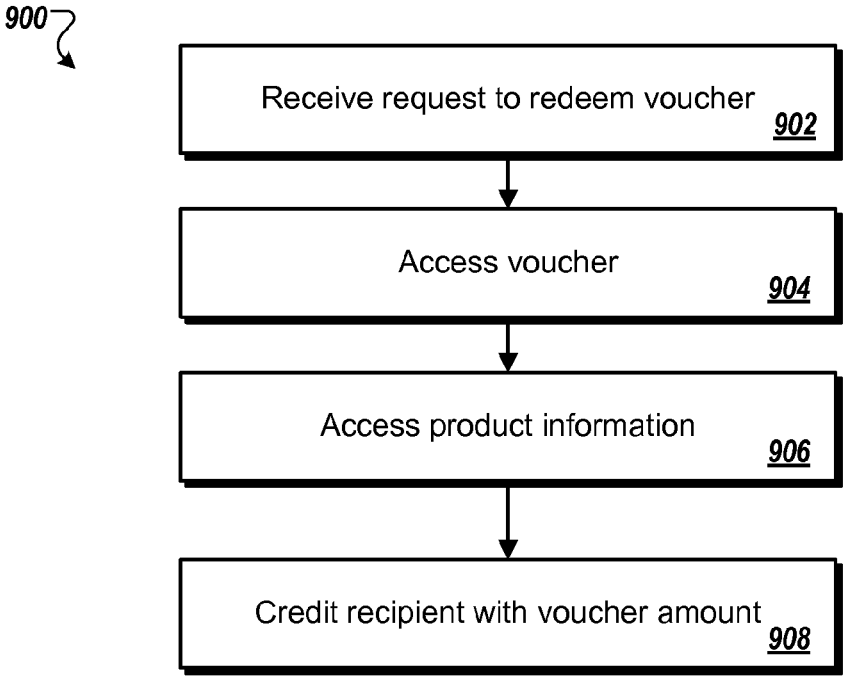
FIG. 9 is an illustrative flow chart showing example operations for redeeming a voucher.

FIG. 9 is an illustrative flow chart showing example operations 900 for redeeming a voucher where the value of the voucher is credited to a registrant's account. For example, the network architecture 100 in FIG. 1 can perform the operations 800. The operations 900 are described with reference to FIGS. 5A-5B.

The operations 900 begin by receiving a request to redeem a voucher in operation 902. For example, the registrant (gift recipient) can access the registrant's gift registry for an online retail web site using a web browser running on client 108. Display device 108*a* can display a web page for the registrant's gift registry enabling the registrant to review the status of the registrant's gift registry. The web page can indicate the availability of one or more vouchers for purchased products or items from the registrant's gift registry that are part of the ship later program. The web page can include controls that the registrant can activate to request the redemption of a voucher in order to credit the value of the voucher to the registrant's account. The voucher is accessed in operation 904. For example, once the registrant activates the control to redeem the voucher for credit to the registrant's account, the voucher is accessed to determine the voucher value. Product information is accessed in operation 906. For example, once the registrant activates the control to redeem the voucher, the product information associated with the voucher is accessed. The recipient is credited with the voucher amount in operation 908. For example, once the registrant activates the control to redeem the voucher for credit to the registrant's account, a pop-up window can display the voucher value and product information for the product associated with the voucher. A control can be included in the pop-up window that, when activated by the registrant, will credit the voucher amount for the product to the registrant's account with the on-line retailer.

Figure 10:
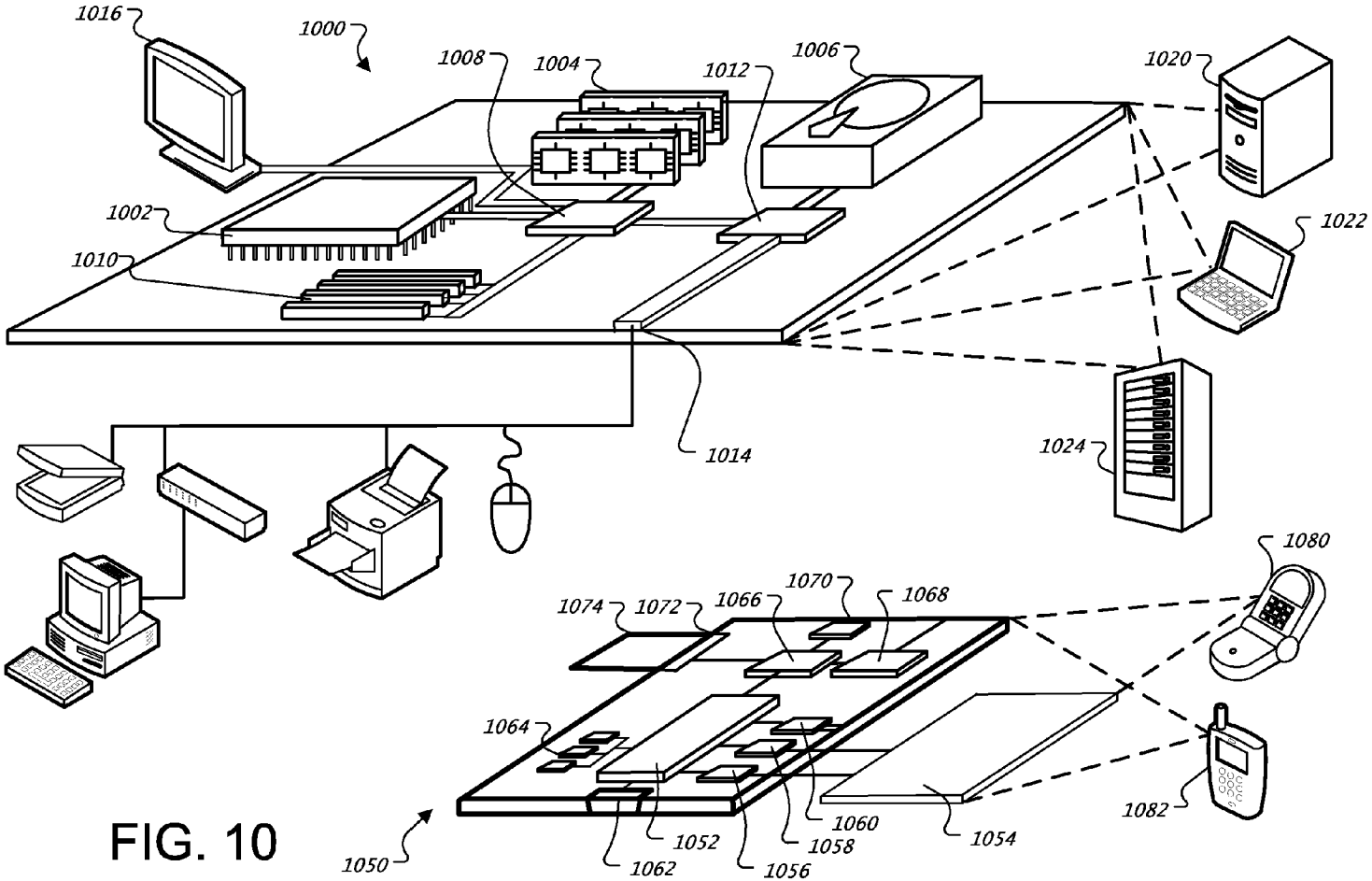
FIG. 10 is a block diagram of computing devices that may be used to implement the systems and methods described in this document.

FIG. 10 is a block diagram of computing devices 1000, 1050 that may be used to implement the systems and methods described in this document, as either a client or as a server or plurality of servers. Computing device 1000 is intended to represent various forms of digital computers, such as laptops, desktops, workstations, personal digital assistants, servers, blade servers, mainframes, and other appropriate computers. Computing device 1050 is intended to represent various forms of mobile devices, such as personal digital assistants, cellular telephones, smartphones, and other similar computing devices. The components shown here, their connections and relationships, and their functions, are meant to be exemplary only.

Computing device 1000 includes a processor 1002, memory 1004, a storage device 1006, a high-speed interface 1008 connecting to memory 1004 and high-speed expansion ports 1010, and a low speed interface 1012 connecting to low speed bus 1014 and storage device 1006. Each of the components 1002, 1004, 1006, 1008, 1010, and 1012, are interconnected using various busses, and may be mounted on a common motherboard or in other manners as appropriate. The processor 1002 can process instructions for execution within the computing device 1000, including instructions stored in the memory 1004 or on the storage device 1006 to display graphical information for a GUI on an external input/output device, such as display 1016 coupled to high speed interface 1008. In other implementations, multiple processors and/or multiple buses may be used, as appropriate, along with multiple memories and types of memory. In addition, multiple computing devices 1000 may be connected, with each device providing portions of the necessary operations (e.g., as a server bank, a group of blade servers, or a multi-processor system).

The memory 1004 stores information within the computing device 1000. In one implementation, the memory 1004 is a computer-readable medium. In one implementation, the memory 1004 is a volatile memory unit or units. In another implementation, the memory 1004 is a non-volatile memory unit or units.

The storage device 1006 is capable of providing mass storage for the computing device 1000. In one implementation, the storage device 1006 is a computer-readable medium. In various different implementations, the storage device 1006 may be a floppy disk device, a hard disk device, an optical disk device, or a tape device, a flash memory or other similar solid state memory device, or an array of devices, including devices in a storage area network or other configurations. In one implementation, a computer program product is tangibly embodied in an information carrier. The computer program product contains instructions that, when executed, perform one or more methods, such as those described above. The information carrier can be or can be implemented on or with a computer- or machine-readable medium, such as the memory 1004, the storage device 1006, and/or memory on processor 1002, for example.

The high-speed controller 1008 manages bandwidth-intensive operations for the computing device 1000, while the low speed controller 1012 manages lower bandwidth-intensive operations. Such allocation of duties is exemplary only. In one implementation, the high-speed controller 1008 is coupled to memory 1004, display 1016 (e.g., through a graphics processor or accelerator), and to high-speed expansion ports 1010, which may accept various expansion cards (not shown). In the implementation, low-speed controller 1012 is coupled to storage device 1006 and low-speed expansion port 1014. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 1000 may be implemented in a number of different forms, as shown in the figure. For example, it may be implemented as a standard server 1020, or multiple times in a group of such servers. It may also be implemented as part of a rack server system 1024. In addition, it may be implemented in a personal computer such as a laptop computer 1022. Alternatively, components from computing device 1000 may be combined with other components in a mobile device (not shown), such as device 1050. Each of such devices may contain one or more of computing device 1000, 1050, and an entire system may be made up of multiple computing devices 1000, 1050 communicating with each other.

Computing device 1050 includes a processor 1052, memory 1064, an input/output device such as a display 1054, a communication interface 1066, and a transceiver 1068, among other components. The device 1050 may also be provided with a storage device, such as a microdrive or other device, to provide additional storage. Each of the components 1050, 1052, 1064, 1054, 1066, and 1068, are interconnected using various buses, and several of the components may be mounted on a common motherboard or in other manners as appropriate.

The processor 1052 can process instructions for execution within the computing device 1050, including instructions stored in the memory 1064. The processor may also include separate analog and digital processors. The processor may provide, for example, for coordination of the other components of the device 1050, such as control of user interfaces, applications run by device 1050, and wireless communication by device 1050.

Processor 1052 may communicate with a user through control interface 1058 and display interface 1056 coupled to a display 1054. The display 1054 may be, for example, a TFT LCD display or an OLED display, or other appropriate display technology. The display interface 1056 may comprise appropriate circuitry for driving the display 1054 to present graphical and other information to a user. The control interface 1058 may receive commands from a user and convert them for submission to the processor 1052. In addition, an external interface 1062 may be provide in communication with processor 1052, so as to enable near area communication of device 1050 with other devices. External interface 1062 may provide, for example, for wired communication (e.g., via a docking procedure) or for wireless communication (e.g., via Bluetooth or other such technologies).

The memory 1064 stores information within the computing device 1050. In one implementation, the memory 1064 is a computer-readable medium. In one implementation, the memory 1064 is a volatile memory unit or units. In another implementation, the memory 1064 is a non-volatile memory unit or units. Expansion memory 1074 may also be provided and connected to device 1050 through expansion interface 1072, which may include, for example, a SIMM card interface. Such expansion memory 1074 may provide extra storage space for device 1050, or may also store applications or other information for device 1050. Specifically, expansion memory 1074 may include instructions to carry out or supplement the processes described above, and may include secure information also. Thus, for example, expansion memory 1074 may be provide as a security module for device 1050, and may be programmed with instructions that permit secure use of device 1050. In addition, secure applications may be provided via the SIMM cards, along with additional information, such as placing identifying information on the SIMM card in a non-hackable manner.

The memory may include for example, flash memory and/or MRAM memory, as discussed below. In one implementation, a computer program product is tangibly embodied in an information carrier. The computer program product contains instructions that, when executed, perform one or more methods, such as those described above. The information carrier can be or can be implemented on or with a computer- or machine-readable medium, such as the memory 1064, expansion memory 1074, and/or memory on processor 1052, for example.

Device 1050 may communicate wirelessly through communication interface 1066, which may include digital signal processing circuitry where necessary. Communication interface 1066 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 1068. In addition, short-range communication may occur, such as using a Bluetooth, WiFi, or other such transceiver (not shown). In addition, GPS receiver module 1070 may provide additional wireless data to device 1050, which may be used as appropriate by applications running on device 1050.

Device 1050 may also communication audibly using audio codec 1060, which may receive spoken information from a user and convert it to usable digital information. Audio codex 1060 may likewise generate audible sound for a user, such as through a speaker, e.g., in a handset of device 1050. Such sound may include sound from voice telephone calls, may include recorded sound (e.g., voice messages, music files, etc.) and may also include sound generated by applications operating on device 1050.

The computing device 1050 may be implemented in a number of different forms, as shown in the figure. For example, it may be implemented as a cellular telephone 1080. It may also be implemented as part of a smartphone 1082, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device. These computer programs (also known as programs, software, software applications or code) include machine instructions for a programmable processor, and can be implemented in a high-level procedural and/or object-oriented programming language, and/or in assembly/machine language.

To provide for interaction with a user, the systems and techniques described herein can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back-end component (e.g., as a data server), or that includes a middleware component (e.g., an application server), or that includes a front-end component (e.g., a client computer having a GUI or a Web browser through which a user can interact with an implementation of the systems and techniques described herein), or any combination of such back-end, middleware, or front-end components. The components of the system can be interconnected by any form or medium of digital data communication (e.g., a communication network). Examples of communication networks include a local area network ("LAN"), a wide area network ("WAN"), and the Internet.

In some cases, online retailers enable a consumer to establish a wish list of selected items. This wish list then can be made available to friends and family members who can select and purchase items from the wish list for direct shipment to the consumer.

The computing system can include clients and servers. A client and server are generally remote from each other and typically interact through a communication network. The relationship of client and server arises by virtue of computer programs running on the respective computers and having a client-server relationship to each other. A number of implementations have been described. Nevertheless, it will be understood that various modifications may be made. Accordingly, other implementations are within the scope of the following claims.

What is claimed is:

1. A computer-implemented method of managing an electronic gift registry, the method comprising:

establishing, by one or more configured server computers, an electronic gift registry for a registrant;

accessing, by the one or more configured server computers from a computer memory storage system, information about multiple different products that are available to be added to the registrant's gift registry;

initiating, by the one or more configured server computers, display of a graphical user interface to the registrant at a client computing system, the graphical user interface presenting indications of at least some of the different products that are available to be added to the registrant's gift registry;

updating, by the one or more configured server computers, the registrant's electronic gift registry to include one or more products that are added by the registrant via interactions with the graphical user interface; and receiving, by the one or more configured server computers, information from interactions of the registrant with the graphical user interface to designate, for each of the one or more products, whether the product, once purchased by a gift giver, is shippable at any time or is not to be shipped until after receiving a future authorization from the registrant to ship the product.

2. The computer-implemented method of claim 1 further comprising updating, by the one or more configured server computers, the registrant's electronic gift registry to include a shipment designation for each product included in the registrant's electronic gift registry to indicate whether the product is shippable at any time or is not to be shipped until after receiving a future authorization from the registrant, and wherein the updated electronic gift registry is stored in the computer memory storage system.

3. The computer-implemented method of claim 1 further comprising:

receiving, by the one or more configured server computers, an indication that the registrant has activated, by interacting with the graphical user interface, a corresponding shipping hold option for each of the one or more products to designate that the one or more products are not to be shipped until after receiving the future authorization from the registrant to ship the products; and updating, by the one or more configured server computers, the registrant's electronic gift registry to reflect the corresponding shipping hold option for each of the one or more products.

4. A computer-implemented method of managing an electronic gift registry, the method comprising:

establishing, by one or more configured server computers, an electronic gift registry for a registrant;

receiving, by the one or more configured server computers, an indication of a critical date specified by the registrant, the critical date specified by the registrant being a date in the future;

accessing, by the one or more configured server computers from a computer memory storage system, information about multiple different products that are available to be added to the registrant's gift registry;

initiating, by the one or more configured server computers, display of a graphical user interface to the registrant at a client computing system, the graphical user interface presenting indications of at least some of the different products that are available to be added to the registrant's gift registry;

updating, by the one or more configured server computers, the registrant's electronic gift registry to include one or more products that are added by the registrant via interactions with the graphical user interface; and receiving, by the one or more configured server computers, information from interactions of the registrant with the graphical user interface to designate, for each of the one or more products, whether the product, once purchased by a gift giver, is shippable at any time or is not to be shipped until after the critical date specified by the registrant.

5. The computer-implemented method of claim 4 further comprising updating, by the one or more configured server computers, the registrant's electronic gift registry to include an indication of the critical date and a shipment designation for each product included in the registrant's electronic gift registry to indicate whether the product is shippable at any time or is not to be shipped until after the critical date, and wherein the updated electronic gift registry is stored in the computer memory storage system.

6. The computer-implemented method of claim 4 further comprising:

receiving, by the one or more configured server computers, an indication that the registrant has activated, by interacting with the graphical user interface, a corresponding shipping hold option for each of the one or more products to designate that the one or more products are not to be shipped until after the critical data specified by the registrant; and updating, by the one or more configured server computers, the registrant's electronic gift registry to reflect the corresponding shipping hold option for each of the one or more products.

7. A non-transitory computer storage medium encoded with a computer program, the program comprising instructions for managing an electronic gift registry that when executed by a server computer cause the server computer to perform operations comprising:

establishing, by the server computer, an electronic gift registry for a registrant;

accessing, by the server computer from a computer memory storage system, information about multiple different products that are available to be added to the registrant's gift registry;

initiating, by the server computer, display of a graphical user interface to the registrant at a client computing system, the graphical user interface presenting indications of at least some of the different products that are available to be added to the registrant's gift registry;

updating, by the server computer, the registrant's electronic gift registry to include one or more products that are added by the registrant via interactions with the graphical user interface; and receiving, by the server computer, information from interactions of the registrant with the graphical user interface to designate, for each of the one or more products, whether the product, once purchased by a gift giver, is shippable at any time or is not to be shipped until after receiving a future authorization from the registrant to ship the product.

8. The non-transitory computer storage medium of claim 7 wherein the operations further comprise updating, by the server computer, the registrant's electronic gift registry to include a shipment designation for each product included in the registrant's electronic gift registry to indicate whether the product is shippable at any time or is not to be shipped until after receiving a future authorization from the registrant, and wherein the updated electronic gift registry is stored in the computer memory storage system.

9. The non-transitory computer storage medium of claim 7 wherein the operations further comprise updating, by the server computer, the registrant's electronic gift registry to reflect activation by the registrant of a corresponding shipping hold option for each of the one or more products to designate that the one or more products are not to be shipped until after receiving the future authorization from the registrant to ship the products.

10. A non-transitory computer storage medium encoded with a computer program, the program comprising instructions for managing an electronic gift registry that when executed by a server computer cause the server computer to perform operations comprising:

establishing, by the server computer, an electronic gift registry for a registrant;

receiving, by the server computer, an indication of a critical date specified by the registrant, the critical date specified by the registrant being a date in the future;

accessing, by the server computer from a computer memory storage system, information about multiple different products that are available to be added to the registrant's gift registry;

initiating, by the server computer, display of a graphical user interface to the registrant at a client computing system, the graphical user interface presenting indications of at least some of the different products that are available to be added to the registrant's gift registry;

updating, by the server computer, the registrant's electronic gift registry to include one or more products that are added by the registrant via interactions with the graphical user interface; and receiving, by the server computer, information from interactions of the registrant with the graphical user interface to designate, for each of the one or more products, whether the product, once purchased by a gift giver, is shippable at any time or is not to be shipped until after the critical date specified by the registrant.

11. The non-transitory computer storage medium of claim 10 wherein the operations further comprise updating, by the server computer, the registrant's electronic gift registry to include an indication of the critical date and a shipment designation for each product included in the registrant's electronic gift registry to indicate whether the product is shippable at any time or is not to be shipped until after the critical date, and wherein the updated electronic gift registry is stored in the computer memory storage system.

12. The non-transitory computer storage medium of claim 10 wherein the operations further comprise updating, by the server computer, the registrant's electronic gift registry to reflect activation by the registrant of a corresponding shipping hold option for each of the one or more products to designate that the one or more products are not to be shipped until after the critical date specified by the registrant.

13. A computer-implemented system comprising:

a computer memory storage system configured to store instructions;

a display device; and one or more processors configured to execute the instructions from the computer memory storage system to enable display of a graphical user interface on the display device and to enable performing additional activities, the additional activities including:

initiating establishment of an electronic gift registry for a registrant;

accessing, from the computer memory storage system, information about multiple different products that are available to be added to the registrant's gift registry;

displaying, on the display device via the graphical user interface, indications of at least some of the different products that are available to be added to the registrant's gift registry;

initiating adding, to the registrant's electronic gift registry, one or more products indicated by the registrant within the graphical user interface; and initiating designating, in response to interactions by the registrant with the graphical user interface, for each of the one or more products, whether the product, once purchased by a gift giver, is shippable at any time or is not to be shipped until after receiving a future authorization from the registrant to ship the product.

14. The computer-implemented system of claim 13 wherein the additional activities further comprise initiating updating the registrant's electronic gift registry to include in the registrant's electronic gift registry a shipment designation for each product included in the electronic gift registry to indicate whether the product is shippable at any time or is not to be shipped until after receiving a future authorization from the registrant.

15. The computer-implemented system of claim 13, wherein the additional activities further comprise:

initiating activating a corresponding shipping hold option for each of the one or more products.

16. A computer-implemented system comprising:

a computer memory storage system configured to store instructions;

a display device; and one or more processors configured to execute the instructions from the computer memory storage system to enable display of a graphical user interface on the display device and to enable performing additional activities, the additional activities including:

initiating establishment of an electronic gift registry for a registrant;

receiving an indication of a critical date specified by the registrant, the critical date specified by the registrant being a date in the future;

accessing, from the computer memory storage system, information about multiple different products that are available to be added to the registrant's gift registry;

displaying, on the display device via the graphical user interface, indications of at least some of the different products that are available to be added to the registrant's gift registry;

initiating adding, to the registrant's electronic gift registry, one or more products indicated by the registrant within the graphical user interface; and initiating designating, in response to interactions by the registrant with the graphical user interface, for each of the one or more products, whether the product, once purchased by a gift giver, is shippable at any time or is not to be shipped until after the critical date specified by the registrant.

17. The computer-implemented system of claim 16 wherein the additional activities further comprise initiating updating the registrant's electronic gift registry to include in the registrant's electronic gift registry an indication of the critical date and a shipment designation for each product included in the electronic gift registry to indicate whether the product is shippable at any time or is not to be shipped until after the critical date.

18. The computer-implemented system of claim 16 wherein the additional activities further comprise:

initiating, activating a corresponding shipping hold option for each of the one or more products.

19. A system comprising:

one or more computers;

a computer-readable medium coupled to the one or more computers having instructions stored thereon which, when executed by the one or more computers, cause the one or more computers to perform operations including:

establishing an electronic gift registry for a registrant;

accessing, from a computer memory storage system, information about multiple different products that are available to be added to the registrant's gift registry;

initiating display, at a computing system and to the registrant, of a graphical user interface that presents indications of at least some of the different products that are available to be added to the registrant's gift registry; and updating the registrant's electronic gift registry to include one or more products that are added by the registrant via interactions with the graphical user interface; and means for receiving information from interactions of the registrant to designate, for each of the one or more products, whether the product, once purchased by a gift giver, is shippable at any time or is not to be shipped until after receiving a future authorization from the registrant to ship the product.

20. A system comprising:

one or more computers;

a computer-readable medium coupled to the one or more computers having instructions stored thereon which, when executed by the one or more computers, cause the one or more computers to perform operations including:

establishing an electronic gift registry for a registrant;

receiving an indication of a critical date specified by the registrant, the critical date specified by the registrant being a date in the future;

accessing, from a computer memory storage system, information about multiple different products that are available to be added to the registrant's gift registry;

initiating display, at a computing system and to the registrant, of a graphical user interface that presents indications of at least some of the different products that are available to be added to the registrant's gift registry; and updating the registrant's electronic gift registry to include one or more products that are added by the registrant via interactions with the graphical user interface; and means for receiving information from interactions of enabling the registrant to designate, for each of the one or more products, whether the product, once purchased by a gift giver, is shippable at any time or is not to be shipped until after the critical date specified by the registrant.

* * * * *

UNITED STATES PATENT AND TRADEMARK OFFICE

CERTIFICATE OF CORRECTION

PATENT NO. : 8,560,401 B1
APPLICATION NO. : 13/019800
DATED : October 15, 2013
INVENTOR(S) : Vinit Bharara et al.

It is certified that error appears in the above-identified patent and that said Letters Patent is hereby corrected as shown below:

Title Page 2, line 3, Item (56) under Other Publications:
""Learn more-Reserve Membership Program" [online]. Williams-Sonoma, Inc. 2011, [retrieved on February 2, 2011]. Retrieved from the Internet: <URL: http://www.williams-sonoma.com/ customer-senvice/membership/faq.html#q 00>." should read, --"Learn more-Reserve Membership Program" [online]. Williams-Sonoma, Inc. 2011, [retrieved on February 2, 2011]. Retrieved from the Internet: <URL: http://www.williams-sonoma.com/customer-service/ membership/faq.htmt#q00>.--.

Signed and Sealed this
Twenty-fourth Day of June, 2014

Michelle K. Lee

Michelle K. Lee
*Deputy Director of the United States Patent and Trademark Office*